US010648395B2

(12) United States Patent
Nomura et al.

(10) Patent No.: US 10,648,395 B2
(45) Date of Patent: May 12, 2020

(54) COOLING-WATER CONTROL VALVE DEVICE

(71) Applicant: DENSO CORPORATION, Kariya, Aichi-pref. (JP)

(72) Inventors: Yoko Nomura, Kariya (JP); Takahito Suzuki, Kariya (JP); Shuhei Kuwano, Kariya (JP)

(73) Assignee: DENSO CORPORATION, Kariya (JP)

( * ) Notice: Subject to any disclaimer, the term of this patent is extended or adjusted under 35 U.S.C. 154(b) by 43 days.

(21) Appl. No.: 16/022,854

(22) Filed: Jun. 29, 2018

(65) Prior Publication Data

US 2019/0003370 A1 Jan. 3, 2019

(30) Foreign Application Priority Data

Jul. 3, 2017 (JP) ..... 2017-130360

(51) Int. Cl.

| | |
|---|---|
| ***F01P 7/16*** | (2006.01) |
| ***F01P 11/02*** | (2006.01) |
| ***F01P 11/16*** | (2006.01) |
| *F01P 7/14* | (2006.01) |

(52) U.S. Cl.

CPC ..... *F01P 7/165* (2013.01); *F01P 11/02* (2013.01); *F01P 11/16* (2013.01); *F01P 2007/146* (2013.01); *F01P 2025/08* (2013.01); *F01P 2031/00* (2013.01); *F01P 2031/32* (2013.01)

(58) Field of Classification Search

CPC ..... F01P 7/165; F01P 7/14; F01P 2007/146; F01P 11/16; F01P 11/02; F01P 2031/00; F01P 2031/02

See application file for complete search history.

(56) References Cited

U.S. PATENT DOCUMENTS

2010/0212612 A1 8/2010 Vacca et al.
2016/0010536 A1* 1/2016 Murakami ..... F16K 11/085 137/625.44

* cited by examiner

*Primary Examiner* — Jacob M Amick
(74) *Attorney, Agent, or Firm* — Nixon & Vanderhye PC

(57) ABSTRACT

A main valve unit is rotatably provided in a main valve accommodation space connected to a first opening portion. A fail-safe valve unit is provided in a fail-safe valve accommodation space connected to a second opening portion. The main valve unit controls flow rate of cooling water flowing from the first opening portion to a radiator via a main water passage formed in a housing depending on a rotational position thereof. The fail-safe valve unit is closed when temperature of the cooling water is lower than a predetermined value, to thereby block off flow of the cooling water to the radiator. The fail-safe valve unit is opened when the temperature of the cooling water is higher than the predetermined value, to thereby allow the flow of the cooling water to the radiator. Each of the first opening portion and the main valve accommodation space is fluidically separated from the second opening portion and the fail-safe valve accommodation space by a partitioning wall formed in the housing.

13 Claims, 12 Drawing Sheets

COOLING-WATER CONTROL VALVE DEVICE

CROSS REFERENCE TO RELATED APPLICATION

This application is based on Japanese Patent Application No. 2017-130360 filed on Jul. 3, 2017, the disclosure of which is incorporated herein by reference.

FIELD OF TECHNOLOGY

The present disclosure relates to a cooling-water control valve device for an internal combustion engine.

BACKGROUND

The cooling-water control valve device is known in the art for controlling a flow rate of cooling water for the internal combustion engine (hereinafter, the engine). For example, in the cooling-water control valve device (hereinafter, the water valve device) disclosed in Japanese Patent Publication No. 2016-188702, a valve member of a main valve unit is rotatably provided in a main valve accommodation space for controlling the flow rate of the cooling water to be supplied to the engine.

The water valve device of the above prior art has a fail-safe valve unit provided in a fail-safe valve accommodation space. The fail-safe valve accommodation space is communicated to the main valve accommodation space and a main water passage, through which the cooling water flows from the main valve accommodation space to an outside of the water valve device (for example, a radiator). When temperature of the cooling water is lower than a predetermined value, the fail-safe valve unit is closed so as to block off flow of the cooling water from the fail-safe valve accommodation space to the main water passage. On the other hand, when the temperature of the cooling water is higher than the predetermined value, the fail-safe valve unit is opened so as to allow the flow of the cooling water from the fail-safe valve accommodation space to the main water passage. When the main valve unit becomes unable to rotate in the main valve accommodation space, the flow of the cooling water from the main valve accommodation space to the radiator via the main water passage is blocked off. Then, the temperature of the cooling water is increased. When the temperature of the cooling water becomes higher than the predetermined value, the fail-safe valve unit is opened so as to supply the cooling water (the temperature of which is increased by the engine) to the radiator through the fail-safe valve unit. As above, it is possible to prevent a possible over-heat of the engine, even when the main valve unit becomes unable to rotate.

In the above water valve device, the fail-safe valve accommodation space is communicated to the main valve accommodation space. In a case that extraneous material enters the main valve accommodation space and the main valve unit is locked by such extraneous material, the main valve unit may be broken in the main valve accommodation space. Then, a broken piece of the main valve unit may enter the fail-safe accommodation space and the broken piece may be adhered to a valve portion of the fail-safe valve unit. In such a case, functional failure may occur in the fail-safe valve unit.

SUMMARY OF THE DISCLOSURE

The present disclosure is made in view of the above problem. It is an object of the present disclosure to provide a cooling-water control valve device, which can control functional disorder of a fail-safe valve unit.

According to a feature of the present disclosure, the cooling-water control valve device, which controls flow rate of cooling water to be supplied to a cooling-subject device (for example, an internal combustion engine) of a cooling system, is composed of a housing, a main valve unit and a fail-safe valve unit.

The housing includes;

a main valve accommodation space;

a first opening portion for communicating the main valve accommodation space to the cooling-subject device;

a fail-safe valve accommodation space;

a second opening portion for communicating the fail-safe valve accommodation space to the cooling-subject device;

a main water passage to be connected to a main outside component (for example, a radiator) of the cooling system for communicating the main valve accommodation space to the main outside component; and a fail-safe water passage for communicating the fail-safe valve accommodation space to the main water passage.

The main valve unit is rotatably provided in the main valve accommodation space, so as to control the flow rate of the cooling water from the first opening portion to the main water passage depending on a rotational position of the main valve unit.

The fail-safe valve unit is provided in the fail-safe valve accommodation space and operated in such a manner that;

i) the fail-safe valve unit is closed when temperature of the cooling water is lower than a predetermined value so as to block off flow of the cooling water from the second opening portion to the fail-safe water passage; and ii) the fail-safe valve unit is opened when the temperature of the cooling water is higher than the predetermined value so as to allow the flow of the cooling water from the second opening portion to the fail-safe water passage.

According to the above structure, the fail-safe valve unit is opened when the temperature of the cooling water is increased, in a case that the main valve unit becomes unable to rotate in the main valve accommodation space and the flow of the cooling water from the main water passage to the main outside component is blocked off. Accordingly, it is possible to supply the cooling water from the cooling-subject device (the engine), the temperature of which is increased, to the main outside component (the radiator) of the cooling-water control valve device via the fail-safe valve accommodation space and the fail-safe water passage. In other words, it is possible to prevent the temperature increase of the cooling-subject device (the engine), even in the case that the main valve unit becomes unable to rotate.

The housing further includes a partitioning wall for partitioning each of the first opening portion and the main valve accommodation space from the second opening portion and the fail-safe valve accommodation space. In other words, the second opening portion and the fail-safe valve accommodation space are fluidically separated by the partitioning wall from the first opening portion and the main valve accommodation space.

Even in a case that the extraneous material enters the main valve accommodation space and the main valve unit becomes unable to rotate due to the extraneous material and thereby the main valve unit is broken in the main valve accommodation space, it is possible to prevent the broken piece of the main valve unit from entering the fail-safe valve accommodation space. In other words, it is possible to prevent the broken piece of the main valve unit from being adhered to a valve portion of the fail-safe valve unit and thereby to prevent the functional failure of the fail-safe valve unit.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
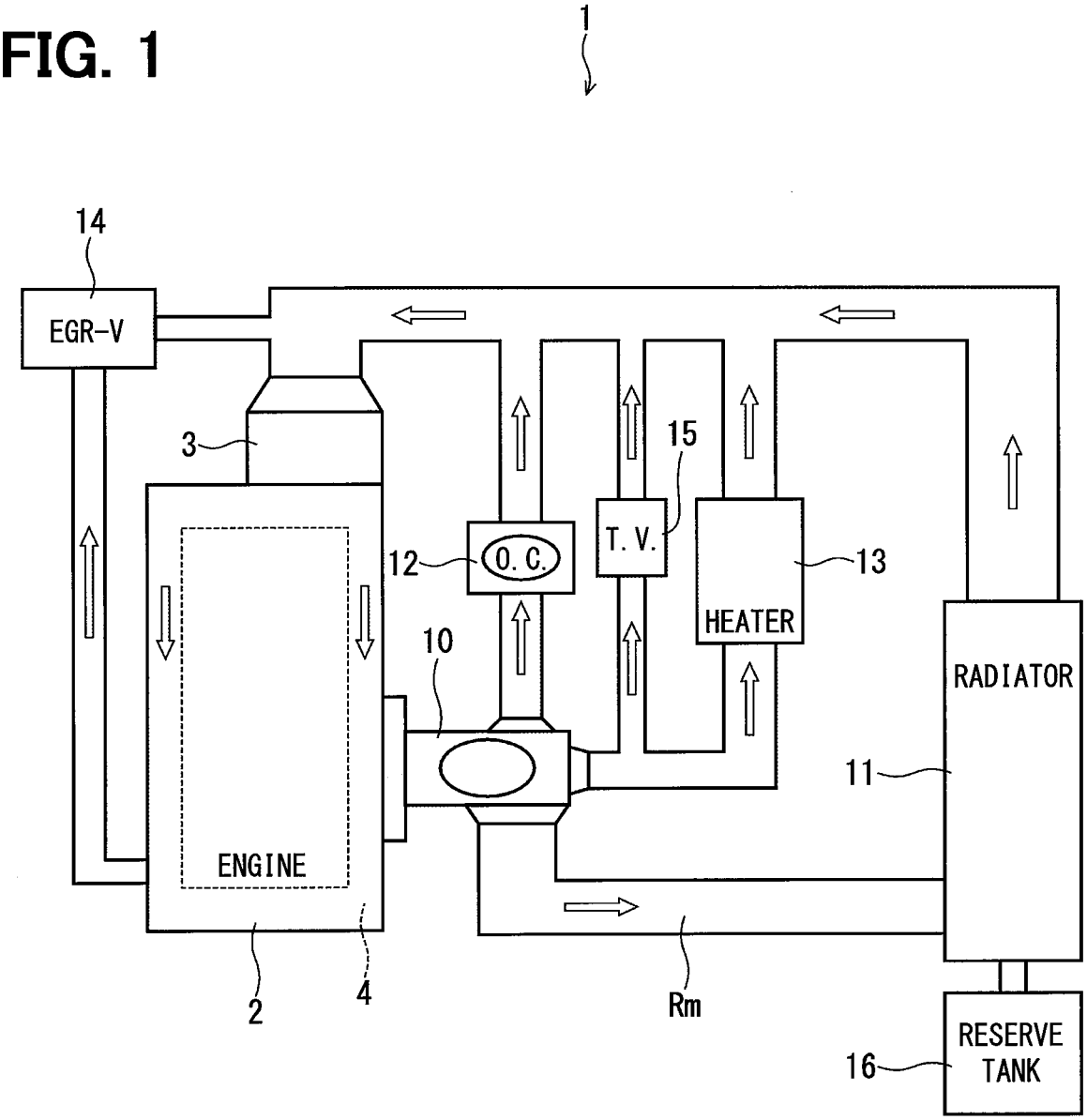
FIG. 1 is a schematic view showing an outline of an engine cooling system, to which a cooling-water control valve device according to a first embodiment of the present disclosure is applied.

The present disclosure will be explained hereinafter by way of multiple embodiments and/or modifications with reference to the drawings. The same reference numerals are given to the same or similar structure and/or portion in order to avoid repeated explanation.

(First Embodiment)

A cooling-water control valve device 10 of a first embodiment is shown in FIGS. 2 to 8 and an engine cooling system 1 is shown in FIG. 1, wherein the cooling-water control valve device 10 is applied to the engine cooling system 1.

The cooling-water control valve device 10 (hereinafter, the water valve device 10) is used, for example, for controlling a flow rate of cooling water, which is used for cooling down an internal combustion engine 2 (hereinafter, the engine 2) for an automotive vehicle (not shown). More exactly, the water valve device 10 controls the flow rate of the cooling water flowing through a main water pipe Rm of the engine cooling system 1, as shown in FIG. 1. The engine 2 is also referred to as a cooling-subject device.

As shown in FIG. 1, the engine cooling system 1, the engine 2 and the water valve device 10 are mounted in the automotive vehicle. In addition, the automotive vehicle has a water pump 3, a radiator 11, an oil cooler 12, a heater core 13, an EGR (exhaust gas recirculation) valve 14, a throttle valve 15, a reserve tank 16 and so on, which are collectively referred to as outside components of the water valve device 10. The radiator 11 is further referred to as a main outside component. The engine cooling system 1 includes the main water pipe Rm.

The water pump 3 is provided in the engine 2 so as to be connected to a water jacket 4 of the engine 2. The water pump 3 is driven by a driving force of the engine 2 in order to pressurize the cooling water and to pump out the pressurized cooling water to the water jacket 4.

The water valve device 10 is provided in the engine 2 so as to be connected to the water jacket 4 of the engine 2. The cooling water flows into the water valve device 10 from the water jacket 4 of the engine 2.

The main water pipe Rm connects the water jacket 4 of the engine 2 to the radiator 11 via the water valve device 10, so that the cooling water flows from the water jacket 4 to the radiator 11 via the water valve device 10 and the main water pipe Rm. The radiator 11 radiates heat of the cooling water to an outside of the radiator 11. The cooling water, temperature of which is decreased at the radiator 11, flows into the water pump 3 and the water jacket 4 of the engine 2. The cooling water of the low temperature cools down the engine 2. In the present embodiment, the engine 2 is the cooling-subject device to be cooled down. The water valve device 10 controls the flow rate of the cooling water flowing through the engine 2 and the main water pipe Rm, that is, the cooling water flowing from the engine 2 to the radiator 11.

The oil cooler 12 is provided between the water valve device 10 and the water pump 3. The cooling water from the water jacket 4 of the engine 2 flows into the oil cooler 12 via the water valve device 10 and returns to the engine 2. The oil cooler 12 increases temperature of lubricating oil by the circulation of the cooling water through the oil cooler 12. It is thereby possible to decrease viscosity of the lubricating oil even in a condition that ambient temperature is low. The water valve device 10 can also control the flow rate of the cooling water flowing through the oil cooler 12.

The heater core 13 is likewise provided between the water valve device 10 and the water pump 3 and in parallel to the oil cooler 12. The cooling water from the water jacket 4 of the engine 2 flows into the heater core 13 via the water valve device 10 and returns to the engine 2. The heater core 13 can thereby increase temperature of air to be blown into a passenger compartment of the automotive vehicle. The water valve device 10 can also control the flow rate of the cooling water flowing through the heater core 13.

In the present embodiment, a part of exhaust gas from the engine 2 is recirculated into an air-intake side of the engine 2 through the EGR valve 14 in order to reduce density of nitrogen dioxide in the exhaust gas. The EGR valve 14 controls flow rate of the exhaust gas, which flows through an EGR pipe connecting an exhaust pipe to an intake pipe of the engine 2.

The EGR valve 14 is provided between the water jacket 4 of the engine 2 and the water pump 3. The cooling water from the water jacket 4 of the engine 2 flows back to the engine 2 through the EGR valve 14, so that the EGR valve 14 can be cooled down. During an operation of the engine 2, the cooling water continuously flows through the water pump 3, the water jacket 4 and the EGR valve 14.

The throttle valve 15 is provided in an air-intake passage (not shown) formed in the intake pipe of the engine 2 so as to control flow rate of intake air flowing through the air-intake passage. The throttle valve 15 is provided between the water valve device 10 and the water pump 3 and in parallel to the oil cooler 12 as well as the heater core 13. The cooling water from the water jacket 4 of the engine 2 flows into the throttle valve 15 via the water valve device 10 and returns to the engine 2. It is thereby possible to warm the throttle valve 15 when the ambient temperature is low.

The reserve tank 16, which is also one of the outside components of the engine cooling system 1, is connected to the radiator 11. The cooling water is accumulated in the reserve tank 16. When the amount of the cooling water in the radiator 11 becomes smaller, that is, when the amount of the cooling water in the engine cooling system 1 is decreased, the cooling water is supplied from the reserve tank 16 into the radiator 11. As above, the reserve tank 16 accumulates the cooling water, which is supplied to the engine cooling system 1 when the amount of the cooling water becomes insufficient.

As shown in FIGS. 2 to 8, the water valve device 10 is composed of a housing 20, a main valve unit 30, an electric motor 40, a fail-safe valve unit 50 and so on.

Figure 4:
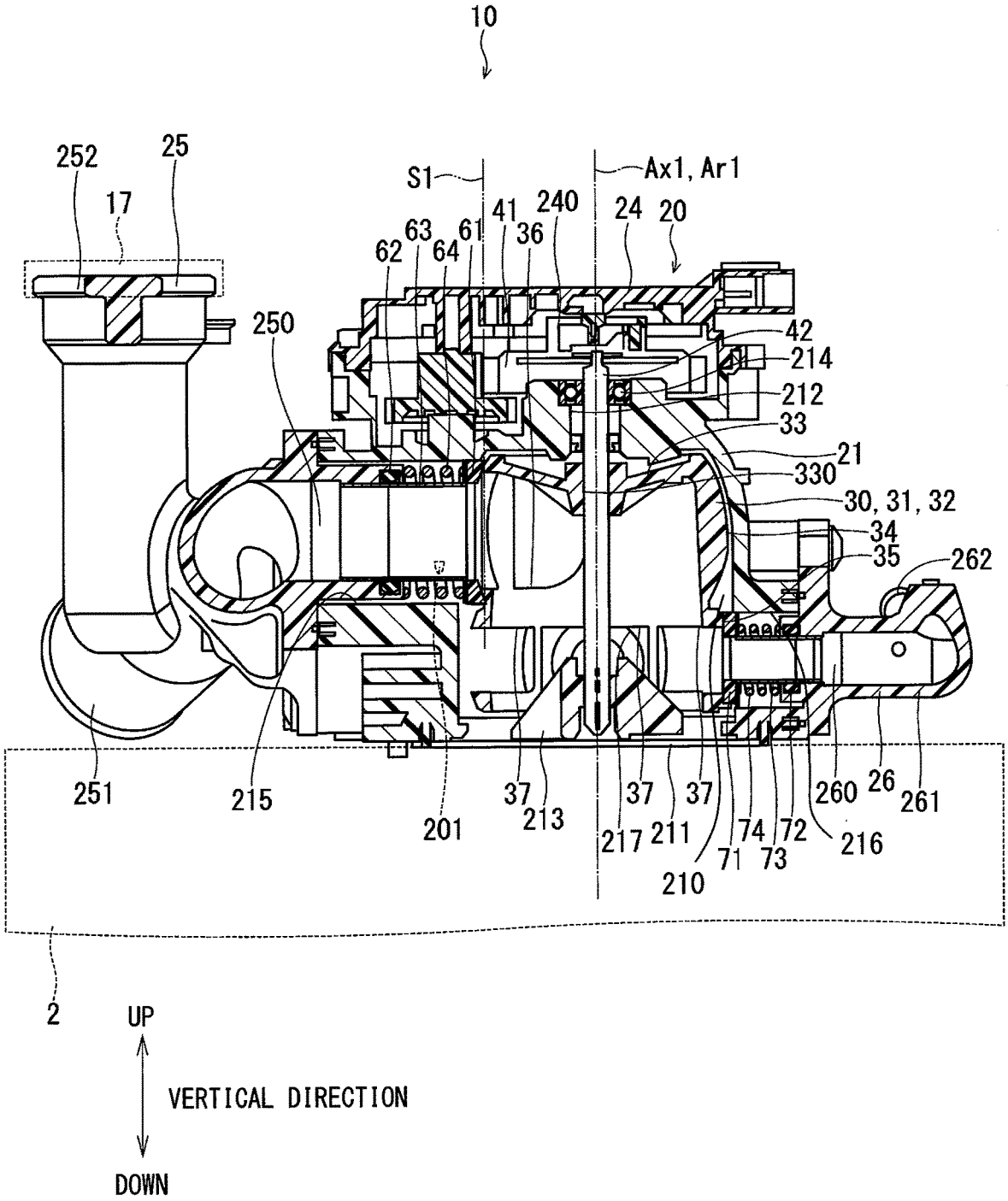
FIG. 4 is a schematic cross sectional view taken along a line IV-IV in FIG. 2.

As shown in FIG. 4, the housing 20 includes a housing body 21, a cover member 24, a first to a third pipe units 25, 26, 27, a first and a second seat portions 61, 71, a first and a second seal members 62, 72, a first and a second holders 63, 73, a first and a second springs 64, 74 and so on.

The housing body 21, the cover member 24, and the pipe units 25, 26, 27 are made of, for example, resin.

Figure 6:
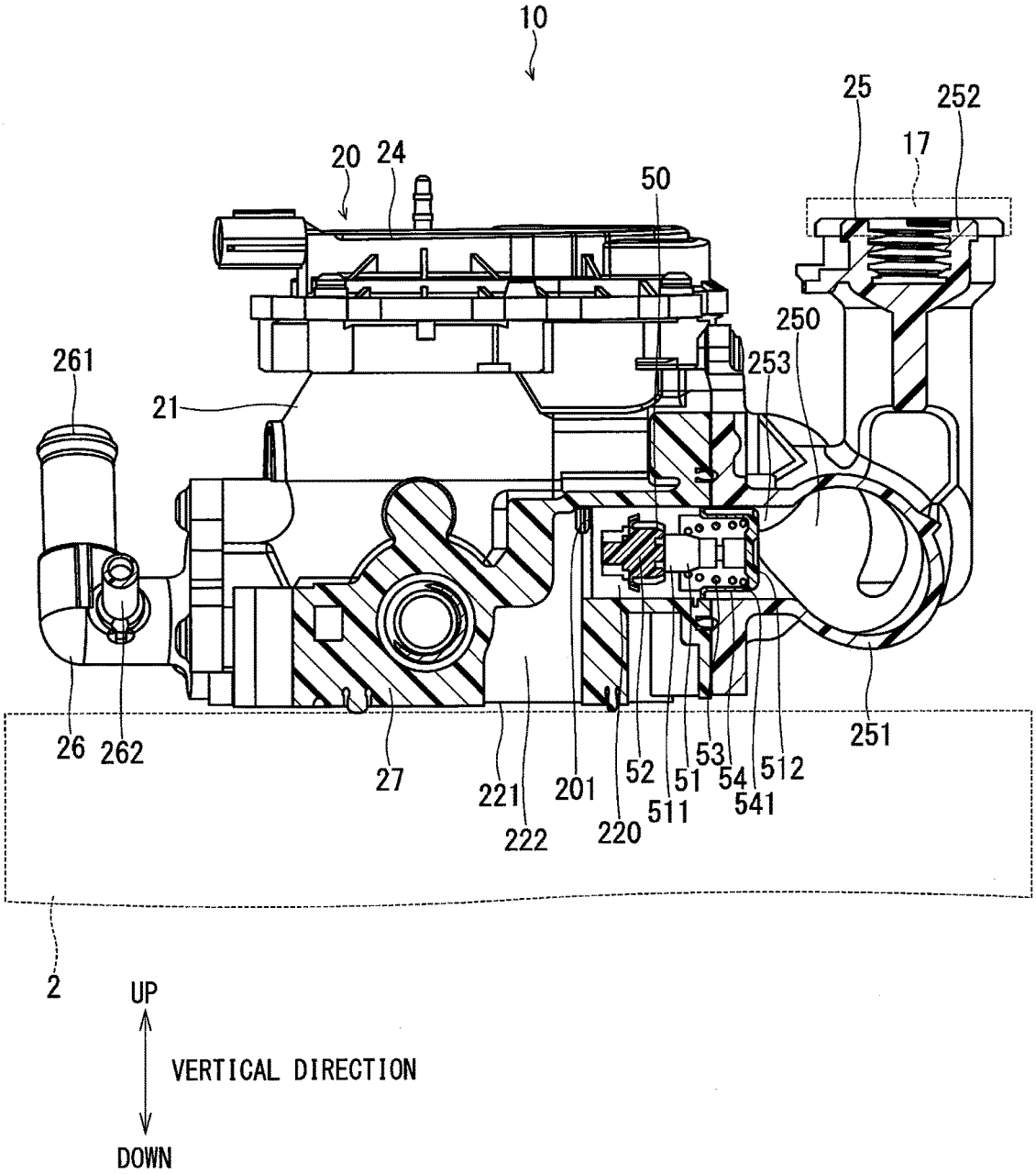
FIG. 6 is a schematic cross sectional view taken along a line VI-VI in FIG. 2.
Figure 7:
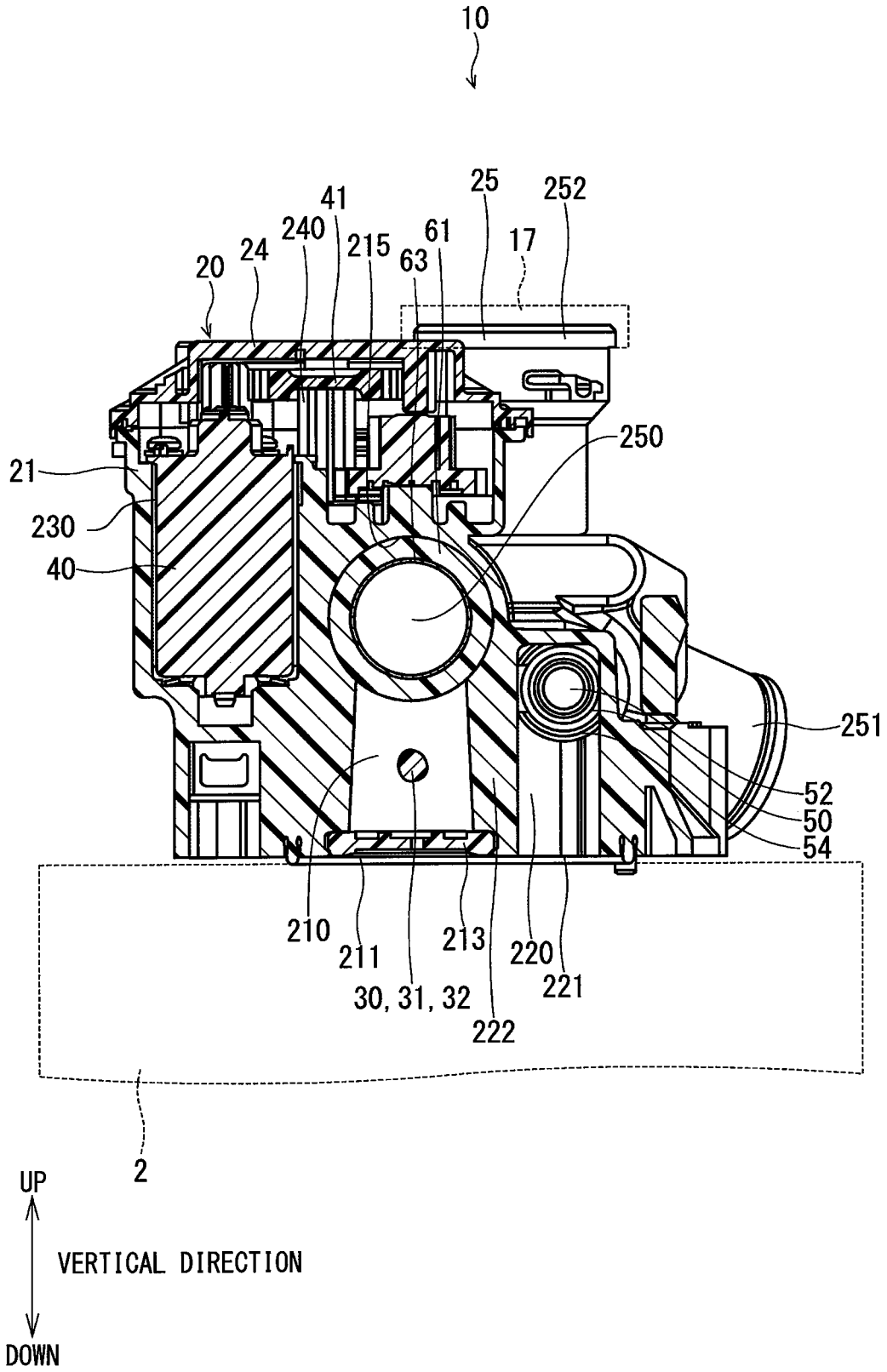
FIG. 7 is a schematic cross sectional view taken along a line VII-VII in FIG. 2.

As shown in FIGS. 4, 6 and 7, the housing body 21 includes a main valve accommodation space 210, a first opening portion 211, a bearing receiving hole 212, a first and a second bearings 213, 214, a first to a third passage hole portions 215, 216, 217, a fail-safe valve accommodation space 220, a second opening portion 221, a partitioning wall 222, a motor accommodation space 230 and so on.

As shown in FIGS. 3, 4, 5 and 7, the main valve accommodation space 210 is formed in the housing body 21 as a space having a cylindrical shape. The first opening portion 211 is formed at a lower-side outer wall of the housing body 21 so as to communicate the main valve accommodation space 210 to an outside of the housing body 21. In other words, the main valve accommodation space 210 is communicated to the engine 2 through the first opening portion 211.

As shown in FIG. 4, the water valve device 10 is fixed to the engine 2 in such a way that the first opening portion 211 of the housing body 21 is connected to the water jacket 4 of the engine 2. The cooling water flows from the water jacket 4 into the main valve accommodation space 210 through the first opening portion 211. As above, the first opening portion 211 is so formed that the main valve accommodation space 210 is connected to the engine 2. The first bearing 213 is provided in the first opening portion 211.

As shown in FIG. 4. The bearing receiving hole 212 is formed in the housing body 21 at an upper-side position of the main valve accommodation space 210 opposite to the first opening portion 211 in an axial direction. The bearing receiving hole 212 is so formed as to connect the main valve accommodation space 210 to an upper-side outer wall of the housing body 21, which is located at the upper-side position opposite to the first opening portion 211 in the axial direction. The bearing receiving hole 212 is coaxially formed with the main valve accommodation space 210. The second bearing 214 is provided in the bearing receiving hole 212.

Each of the first to the third passage hole portions 215, 216 and 217 is formed in the housing body 21 so as to communicate the main valve accommodation space 210 to the outside of the housing 21, more exactly, to each of the outside components (explained below).

Figure 8:
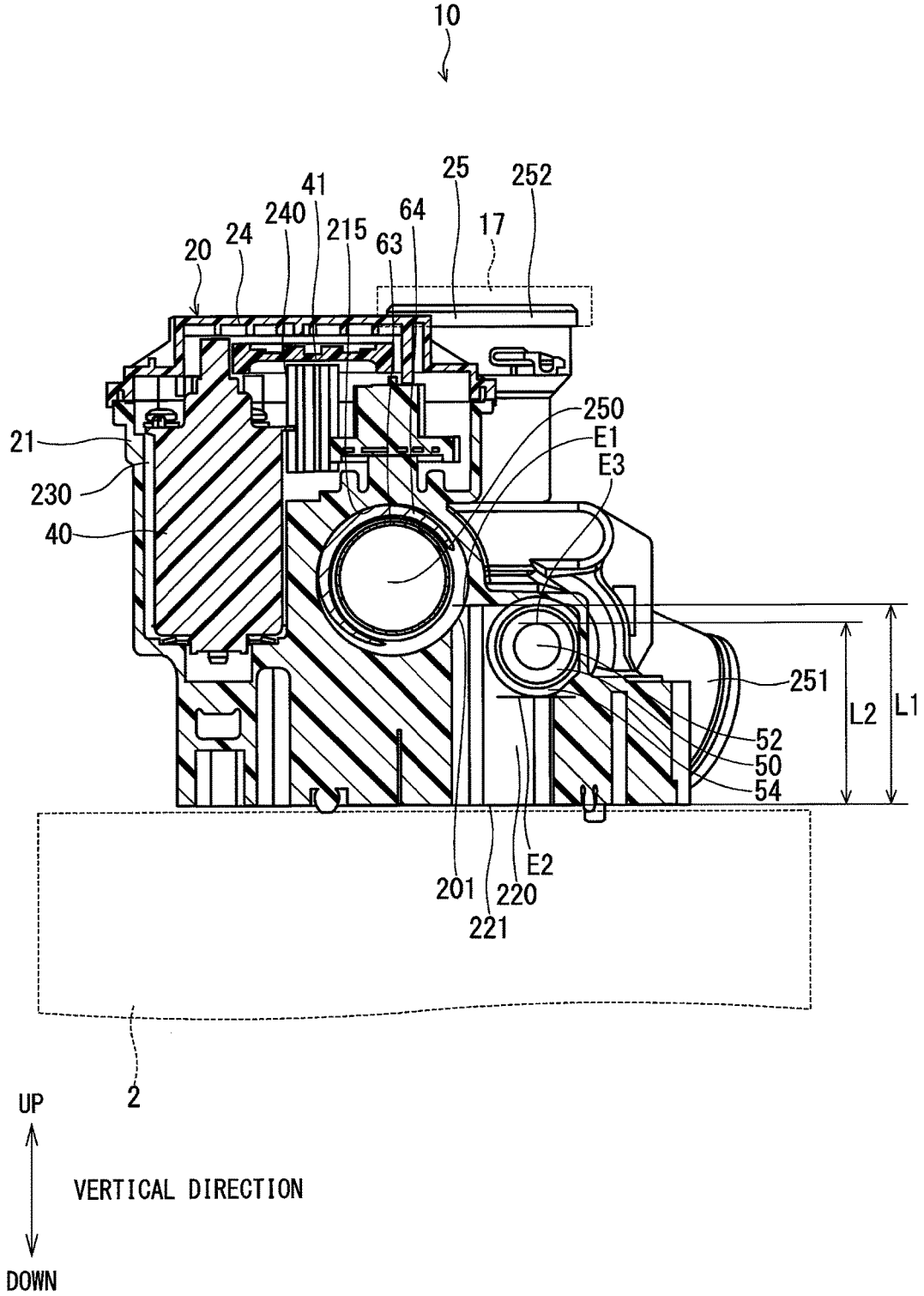
FIG. 8 is a schematic cross sectional view taken along a line VIII-VIII in FIG. 2.

As shown in FIGS. 7 and 8, the motor accommodation space 230 is formed in the housing body 21 so as to open at the upper-side outer wall of the housing body 21, at which the bearing receiving hole 212 is formed.

As shown in FIGS. 4 and 7, the cover member 24 is formed in a dish structure so as to cover the upper-side outer wall of the housing body 21, more exactly, to cover the bearing receiving hole 212. A gear accommodation space 240 is formed between the cover member 24 and the housing body 21. The gear accommodation space 240 is connected to the motor accommodation space 230.

The electric motor 40 is provided in the motor accommodation space 230 so as to be rotated when receiving electric power, to thereby output rotational torque from its output portion.

A gear portion 41 is provided in the gear accommodation space 240 in such a way that the gear portion 41 is engaged with the output portion of the electric motor 40. In the present embodiment, the gear portion 41 works as a speed decreasing unit. In other words, the rotational speed outputted from the electric motor 40 is reduced by the gear portion 41.

Figure 5:
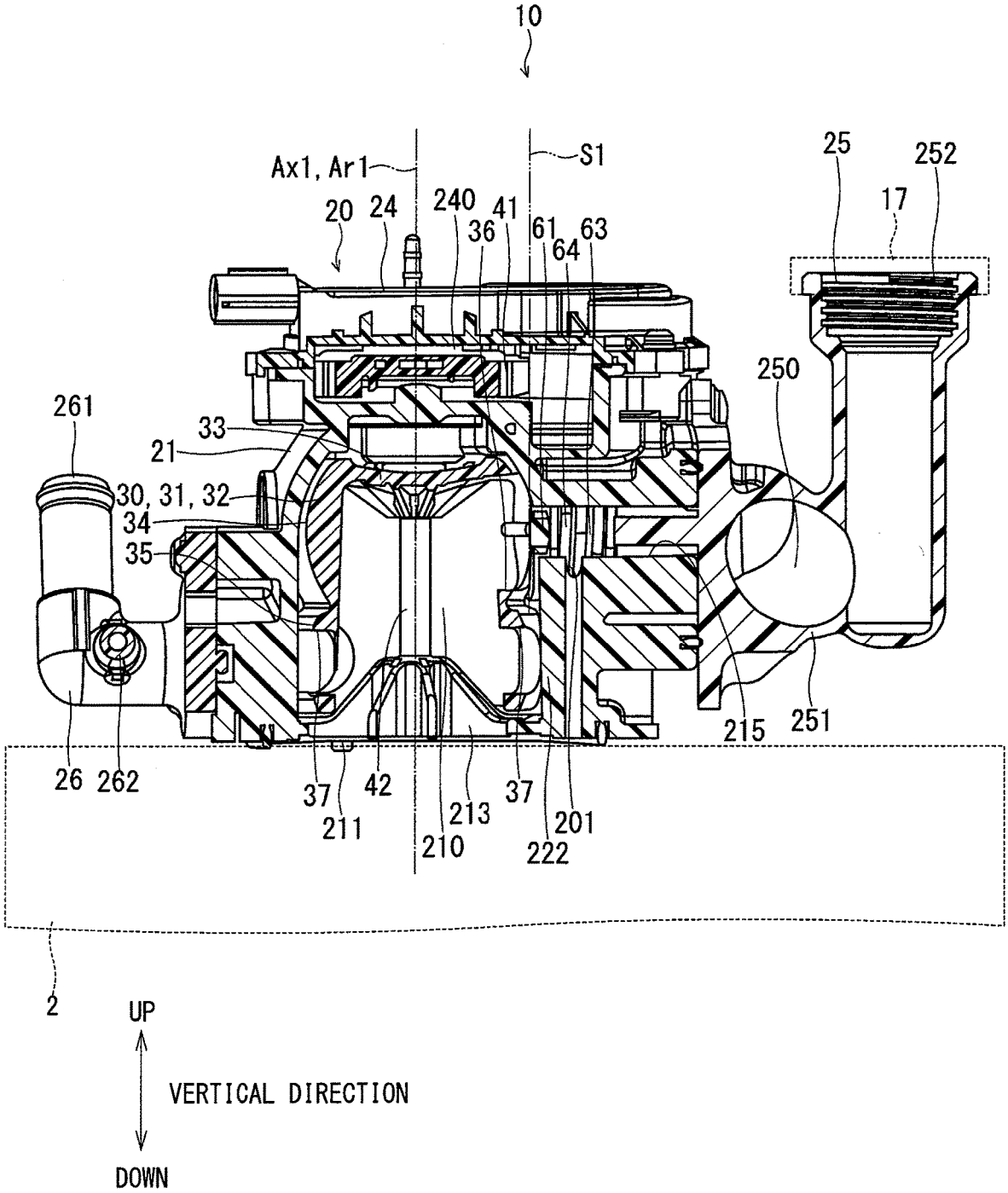
FIG. 5 is a schematic cross sectional view taken along a line V-V in FIG. 2.

As shown in FIGS. 4 and 5, the main valve unit 30 includes a valve body 31, a first ball surface portion 34, a second ball surface portion 35, a first valve communication hole 36, multiple second valve communication holes 37 and so on. The valve body 31 is made of, for example, resin. The valve body 31 has a valve cylindrical portion 32 and a valve upper-end portion 33. The valve cylindrical portion 32 is formed in a cylindrical shape. The valve upper-end portion 33 is integrally formed with the valve cylindrical portion 32 so as to close one of axial ends of the valve cylindrical portion 32 (that is, an upper-side axial end in FIG. 4 or 5). Accordingly, the valve body 31 is formed in the cylindrical shape having a closed end portion.

The first ball surface portion 34 is formed at an outer wall surface of the valve cylindrical portion 32. More exactly, the first ball surface portion 34 is formed on a side closer to the valve upper-end portion 33, that is, on an upper side of the valve cylindrical portion 32 in FIG. 4 or 5. In other words, the first ball surface portion 34 is formed at the outer wall surface of the valve body 31. The first ball surface portion 34 is formed in a convex spherical shape.

The second ball surface portion 35 is likewise formed at the outer wall surface of the valve cylindrical portion 32. More exactly, the second ball surface portion 35 is formed on a lower side of the first ball surface portion 34 opposite to the valve upper-end portion 33 in the axial direction, that is, on a lower side of the valve cylindrical portion 32 in FIG. 4 or 5. The second ball surface portion 35 is also formed in the convex spherical shape.

The first valve communication hole 36 is formed in the first ball surface portion 34 so as to pass through the valve cylindrical portion 32 in a radial direction from an inner wall surface to the outer wall surface of the valve body 31. The first valve communication hole 36 is formed in an oval shape.

In a similar manner, the second valve communication holes 37 are formed in the second ball surface portion 35 so as to pass through the valve cylindrical portion 32 in the radial direction from the inner wall surface to the outer wall surface of the valve body 31. In the present embodiment, multiple second valve communication holes 37 are formed, each of which is formed in a rectangular shape.

The first passage hole portion 215 is formed in the housing body 21 in such a way that its inside end (a right-hand end in FIG. 4) is opened to the main valve accommodation space 210 at an inner peripheral wall of the main valve accommodation space 210 and the inside end is located at a position opposing to the first ball surface portion 34 in the radial direction of the valve body 31. Each of the second and the third passage hole portions 216 and 217 is likewise formed in the housing body 21 at such a position of the inner peripheral wall of the main valve accommodation space 210 so as to oppose to the second ball surface portion 35 in the radial direction.

A shaft insertion hole 330 is formed in the valve body 31 in such a way that the shaft insertion hole 330 passes through the valve body 31 in the axial direction (a thickness direction) of the valve upper-end portion 33 at a center thereof.

A shaft 42 is inserted into the shaft insertion hole 330 of the valve body 31. The shaft 42 is formed in a bar shape, which is made of, for example, metal. The valve body 31 is integrally rotated with the shaft 42.

One of the axial ends of the shaft 42 (a lower-side end) is supported by the first bearing 213, while the other axial end of the shaft 42 (an upper-side end) is supported by the second bearing 214. The valve body 31 and the shaft 42 are rotatably supported by the first and the second bearings 213 and 214. The main valve unit 30 is rotatable in the valve accommodation space 210 about an axis Ax1 of the main valve unit 30.

The gear portion 41 is connected to the upper-side end of the shaft 42. The rotational torque of the electric motor 40 is transmitted to the shaft 42 via the gear portion 41. The valve body 31 is rotated in the main valve accommodation space 210 about an axis of a predetermined rotational axis line Ar1. The first valve communication hole 36 and the first passage hole portion 215 overlap with each other in the radial direction and an overlapping area between them is changed depending on a rotational position of the valve body 31 with respect to the first passage hole portion 215. In a similar manner, each of the second valve communication holes 37 and each of the second and the third passage hole portions 216 and 217 overlap with each other in the radial direction and each of overlapping areas between them is changed depending on the rotational position of the valve body 31.

As shown in FIG. 4, the first pipe unit 25 includes a first pipe portion 251 and a second pipe portion 252. The first pipe portion 251 is formed in a tubular shape. The second pipe portion 252 is bifurcated from the first pipe portion 251 and formed in the tubular shape. The first pipe unit 25 is fixed to the housing body 21 in such a way that one end (a housing-side end) of the first pipe portion 251 is inserted into the first passage hole portion 215. An inside space of the first pipe portion 251 is thereby communicated to the main valve accommodation space 210. A main water passage 250 is formed in the inside space of the first pipe portion 251 so as to communicate the main valve accommodation space 210 to the outside of the water valve device 10.

Figure 2:
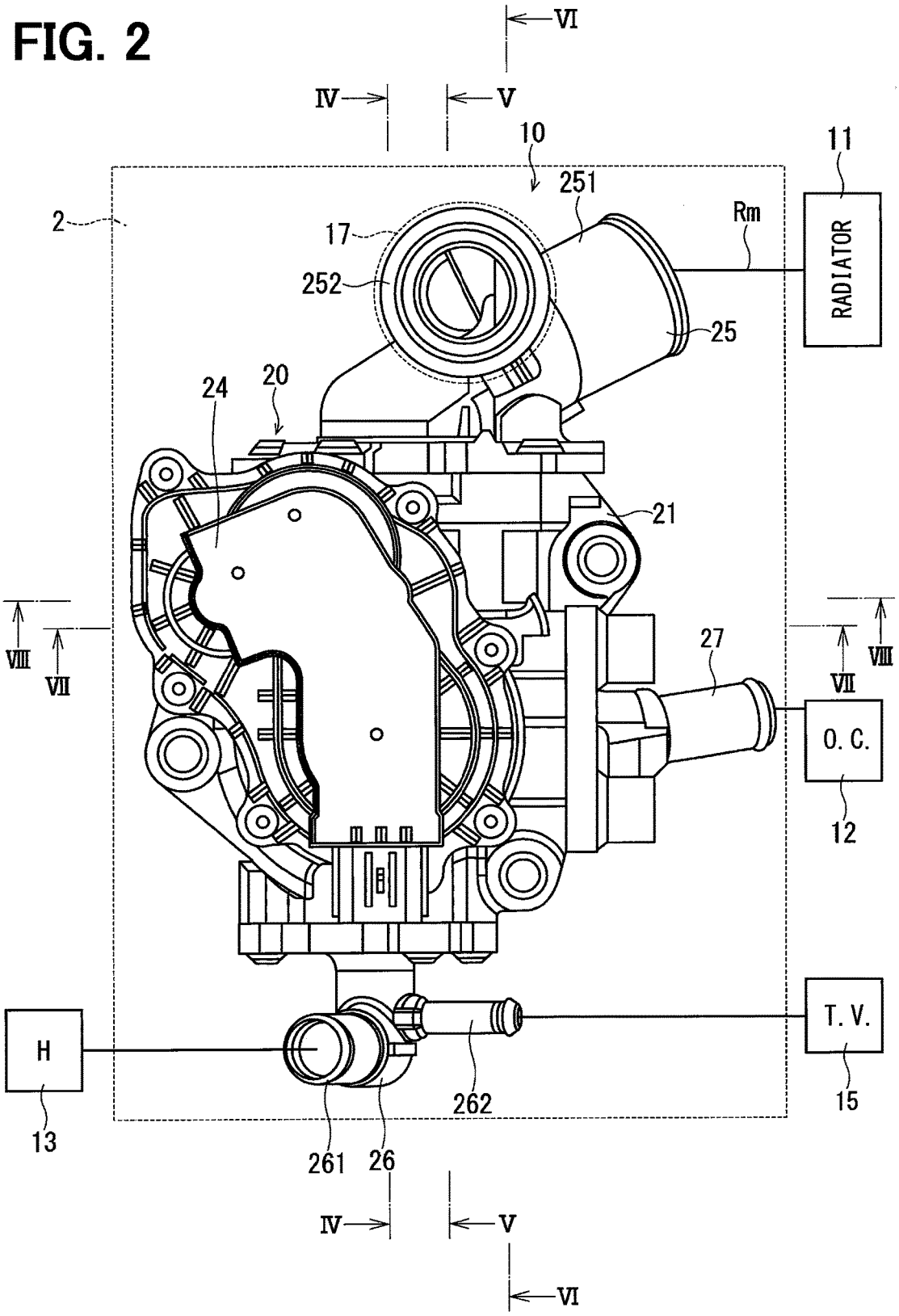
FIG. 2 is a schematic top view showing the cooling-water control valve device of the first embodiment.

The other end of the first pipe portion 251, which is located at the opposite side to the housing-side end fixed to the housing body 21, is connected to the radiator 11 via the main water pipe Rm, as shown in FIG. 2.

A cap 17 is provided at an upper-side end of the second pipe portion 252, which is a pipe end opposite to the first pipe portion 251, so as to close the upper-side end of the second pipe portion 252. In a case that the amount of the cooling water becomes insufficient, the cap 17 is opened so as to supply the cooling water into the engine cooling system 1.

As shown in FIGS. 4 to 6, in a similar manner to the first pipe unit 25, the second pipe unit 26 includes a third pipe portion 261 and a fourth pipe portion 262. The third pipe portion 261 is formed in the tubular shape. The fourth pipe portion 262 is bifurcated from the third pipe portion 261 and formed in the tubular shape. As shown in FIG. 4, the second pipe unit 26 is fixed to the housing body 21 in such a way that one end (a housing-side end) of the third pipe portion 261 is inserted into the second passage hole portion 216. An inside space of the third pipe portion 261 is thereby communicated to the main valve accommodation space 210. A second water passage 260 is formed in the inside space of the third pipe portion 261 so as to communicate the main valve accommodation space 210 to the outside of the water valve device 10. The other end of the third pipe portion 261, which is located at the opposite side to the housing-side end fixed to the housing body 21, is connected to the heater core 13. An outside end of the fourth pipe portion 262, which is a pipe end opposite to the third pipe portion 261, is connected to the throttle valve 15.

Figure 3:
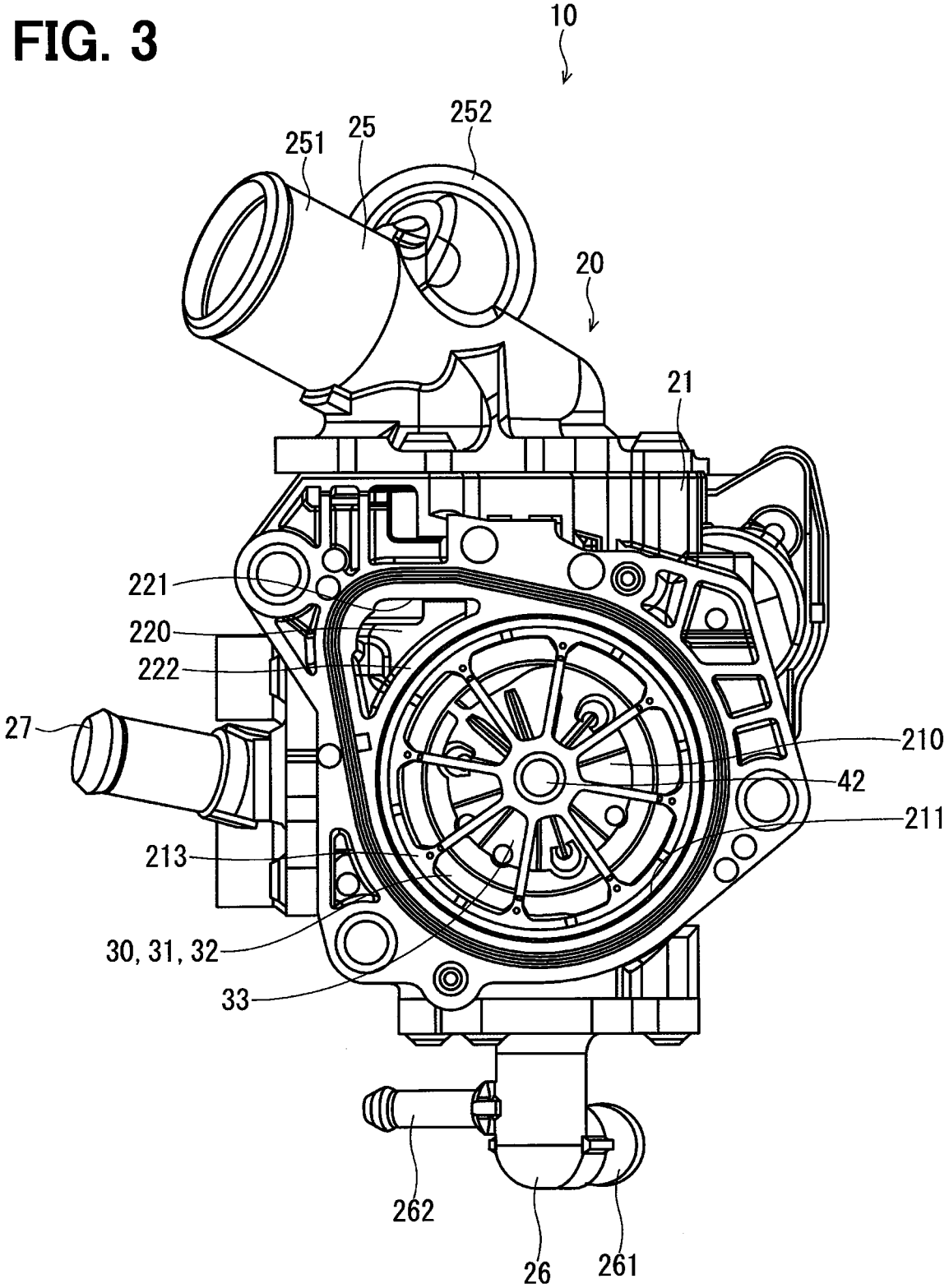
FIG. 3 is a schematic bottom view showing the cooling-water control valve device of the first embodiment.

As shown in FIGS. 2, 3 and 6, the third pipe unit 27 is formed in the tubular shape. The third pipe unit 27 is fixed to the housing body 21 in such a way that one end (a housing-side end) of the third pipe unit 27 is inserted into the third passage hole portion 217. An inside space of the third pipe unit 27 is communicated to the main valve accommodation space 210. The other end of the third pipe unit 27, which is a pipe end opposite to the housing-side end fixed to the housing body 21, is connected to the oil cooler 12.

As shown in FIG. 4, each of the first and the second seat portions 61 and 71 is formed in an annular shape and made of, for example, fluorine resin. A radial-inside surface (a right-hand axial-end surface in FIG. 4) of the first seat portion 61 is operatively in contact with the first ball surface portion 34, while a radial-inside surface (a left-hand axial-end surface in FIG. 4) of the second seat portion 71 is operatively in contact with the second ball surface portion 35.

Each of the first and the second seal members 62 and 72 is formed in an annular shape and made of, for example, rubber. The first seal member 62 is provided in an annular groove, which is formed at an axial end surface of the first pipe portion 251 fixed to the housing body 21. In a similar manner, the second seal member 72 is provided in an annular groove, which is formed at an axial end surface of the third pipe portion 261 fixed to the housing body 21.

Each of the first and the second holders 63 and 73 is formed in a cylindrical shape and made of, for example, metal. One axial end of the first holder 63 (a right-hand end in FIG. 4) holds the first seat portion 61, while the other axial end of the holder 63 (a left-hand end in FIG. 4) is inserted into the housing-side end of the first pipe portion 251, which is fixed to the housing body 21. An outer peripheral surface of the first holder 63 is slidable with respect to an inner peripheral surface of the first seal member 62. According to the above structure, a gap between an inner peripheral surface of the first pipe portion 251 and the first seal member 62 as well as a gap between the outer peripheral surface of the first holder 63 and the first seal member 62 is fluid-tightly maintained.

In a similar manner, one axial end of the second holder 73 (a left-hand end in FIG. 4) holds the second seat portion 71, while the other axial end of the second holder 73 (a right-hand end in FIG. 4) is inserted into the housing-side end of the third pipe portion 261, which is fixed to the housing body 21. An outer peripheral surface of the second holder 73 is slidable with respect to an inner peripheral surface of the second seal member 72. According to the above structure, a gap between an inner peripheral surface of the third pipe portion 261 and the second seal member 72 as well as a gap between the outer peripheral surface of the second holder 73 and the second seal member 72 is fluid-tightly maintained.

Each of the first and the second springs 64 and 74 is composed of a coil spring. The first spring 64 is provided at a radial-outside position of the first holder 63 in such a way that one axial end of the first spring 64 (a right-hand end in FIG. 4) is in contact with a seat-side flanged end of the first holder 63 and the other axial end of the first spring 64 (a left-hand end in FIG. 4) is in contact with the housing-side end of the first pipe portion 251. The first spring 64 has a spring force expandable in its axial direction, so that the first spring 64 biases the first holder 63 and the first seat portion 61 in a direction to the main valve unit 30. Accordingly, the radial-inside surface of the first seat portion 61 is pushed to the first ball surface portion 34.

In a similar manner, the second spring 74 is provided at a radial-outside position of the second holder 73 in such a way that one axial end of the second spring 74 (a left-hand end in FIG. 4) is in contact with a seat-side flanged end of the second holder 73 and the other axial end of the second spring 74 (a right-hand end in FIG. 4) is in contact with the housing-side end of the third pipe portion 261. The second spring 74 has a spring force expandable in its axial direction, so that the second spring 74 biases the second holder 73 and the second seat portion 71 in the direction to the main valve unit 30. Accordingly, the radial-inside surface of the second seat portion 71 is pushed to the second ball surface portion 35.

An inner peripheral surface of the first seat portion 61 as well as an inner peripheral surface of the first holder 63 forms a part of the main water passage 250 together with the inner peripheral surface of the first pipe portion 251. The main water passage 250 is thereby formed in the housing 20. An inner peripheral surface of the second seat portion 71 as well as an inner peripheral surface of the second holder 73 forms a part of the second water passage 260 together with the inner peripheral surface of the third pipe portion 261. The second water passage 260 is also formed in the housing 20.

In the present embodiment, the cooling water flows through the water jacket 4 of the engine 2 and thereby the temperature of the cooling water is increased. The cooling water, the temperature of which is increased as above, flows into the main valve accommodation space 210 via the first opening portion 211 of the housing body 21. More exactly, the cooling water flows along and around the inner and the outer wall surfaces of the valve body 31.

The cooling water flowing into the inside of the valve body 31 flows out to the first pipe portion 251 through a first overlapped opening portion, which is formed between the first valve communication hole 36 and the main water passage 250 (an opening portion of the first seat portion 61). The overlapping area of the first overlapped opening portion varies depending on the rotational position of the valve body 31, so that the flow rate of the cooling water from the first opening portion 211 to the main water passage 250 is changed.

The cooling water flowing out to the first pipe portion 251 is supplied to the radiator 11. The temperature of the cooling water is decreased when it flows through the radiator 11. The cooling water, the temperature of which is decreased at the radiator 11, returns to the engine 2 so as to cool down the engine 2.

When the overlapping area of the first overlapped opening portion between the first valve communication hole 36 and the main water passage 250 is zero, namely when the opening portion of the seat portion 61 is entirely closed by the first ball surface portion 34, the flow of the cooling water from the inside of the valve body 31 to the main water passage 250 is blocked off.

As above, the main valve unit 30 can control the flow rate of the cooling water between the first opening portion 211 and the main water passage 250 depending on the rotational position of the valve body 31. The rotational position of the valve body 31 is controlled by a rotation of the electric motor 40, which is operated by an electronic control unit (not shown).

In addition, the cooling water flowing into the inside of the valve body 31 flows out to the third pipe portion 261 and the fourth pipe portion 262 through a second overlapped opening portion, which is formed between one of the second valve communication holes 37 and the second water passage 260 (an opening portion of the second seat portion 71). The overlapping area of the second overlapped opening portion likewise varies depending on the rotational position of the valve body 31, so that the flow rate of the cooling water from the first opening portion 211 to the second water passage 260 is changed. The cooling water flowing out to the third pipe portion 261 and the fourth pipe portion 262 is respectively supplied to the heater core 13 and the throttle valve 15.

Furthermore, the cooling water flowing into the inside of the valve body 31 flows out to the third pipe unit 27 through a third overlapped opening portion, which is formed between the other of the second valve communication holes 37 and the third passage hole portion 217. The overlapping area of the third overlapped opening portion likewise varies depending on the rotational position of the valve body 31, so that the flow rate of the cooling water from the first opening portion 211 to the third pipe unit 27 is changed. The cooling water flowing out to the third pipe unit 27 is supplied to the oil cooler 12.

The main valve unit 30 is formed in the cylindrical shape and has the first valve communication hole 36 for communicating the inside to the outside of the valve body 31. An axial open end (a lower-side end) of the valve body 31 is connected to the first opening portion 211. The main valve unit 30 is rotatable about the axis Ax1. The flow rate of the cooling water flowing from the first opening portion 211 to the main water passage 250 is controlled by changing the rotational position of the main valve unit 30 and the first overlapped opening portion, which is formed between the first valve communication hole 36 and the main water passage 250.

In the water valve device 10, the electric motor 40 is rotated so as to change the rotational position of the main valve unit 30. As a result, it is possible to control the respective flow rates of the cooling water to be supplied to each of the outside components, including the radiator 11 (the main outside component), the heater core 13, the throttle valve 15 and the oil cooler 12.

As shown in FIGS. 3 and 5 to 8, the fail-safe valve accommodation space 220 is formed in the housing body 21.

The second opening portion 221 is formed in the lower-side outer wall of the housing body 21, in which the first opening portion 211 is also formed. The second opening portion 221 communicates the fail-safe valve accommodation space 220 to the outside of the housing body 21 (that is, to the engine 2).

A fail-safe water passage 253 is formed in the first pipe unit 25, as shown in FIG. 6. The fail-safe water passage 253 is communicated to the fail-safe valve accommodation space 220 and the main water passage 250.

The partitioning wall 222 fluidically partitions each of the second opening portion 221 and the fail-safe valve accommodation space 220 from the first opening portion 211 and the main valve accommodation space 210. As a result, the cooling water flowing into the main valve accommodation space 210 via the first opening portion 211 does not flow into the fail-safe valve accommodation space 220 because of the partitioning wall 222. Ina similar manner, the cooling water flowing into the fail-safe valve accommodation space 220 via the second opening portion 221 cannot flow into the main valve accommodation space 210 because of the partitioning wall 222.

As above, each of the second opening portion 221 and the fail-safe valve accommodation space 220 is segregated by the partitioning wall 222 from the first opening portion 211 and the main valve accommodation space 210. Even in a case that any extraneous material enters the main valve accommodation space 210 and thereby the rotation of the main valve unit 30 is blocked or the main valve unit 30 is damaged, it is possible to prevent a broken piece of the main valve unit 30 from entering the fail-safe valve accommodation space 220.

As shown in FIG. 6, the fail-safe valve unit 50 is provided in the fail-safe valve accommodation space 220. The fail-safe valve unit 50 is composed of a valve portion 51, a temperature responsive portion 52, a spring 53, a supporting member 54 and so on. The supporting member 54 is formed in a cylindrical shape and made of, for example, metal. One end of the supporting member 54 (a left-hand end in FIG. 6) is located in the fail-safe valve accommodation space 220, while the other end of the supporting member 54 (a right-hand end in FIG. 6) is located in the fail-safe water passage 253 of the first pipe unit 25. An outer peripheral wall of the supporting member 54 is fluid-tightly in contact with an inner peripheral wall of the fail-safe valve accommodation space 220 formed in the housing body 21. A valve seat portion 541 is formed at the right-hand end of the supporting member 54.

The valve portion 51 has a shaft portion 511 and a valve head portion 512. The shaft portion 511 is formed in a bar shape and movably provided in the supporting member 54, so that the shaft portion 511 is movable in its axial direction. The valve head portion 512 is formed in a disc shape and attached to a right-hand end of the shaft portion 511. The valve head portion 512 is operatively in contact with the valve seat portion 541 formed at the right-hand end of the supporting member 54, so as to close the valve seat portion 541. The valve head portion 512 is reciprocated in an axial direction of the fail-safe valve unit 50 together with the shaft portion 511, so that the valve head portion 512 is brought into contact with the valve seat portion 541 or separated from the valve seat portion 541.

When the valve head portion 512 is brought into contact with the valve seat portion 541 so as to close the same, the fail-safe water passage 253 is closed to block off the flow of the cooling water through the fail-safe water passage 253. On the other hand, when the valve head portion 512 is separated from the valve seat portion 541 so as to open the same, the fail-safe water passage 253 is opened to allow the flow of the cooling water through the fail-safe water passage 253. In the present disclosure, a direction in which the valve head portion 512 is separated from the valve seat portion 541 is referred to as a fail-safe valve opening direction, and a direction in which the valve head portion 512 is brought into contact with the valve seat portion 541 is referred to as a fail-safe valve closing direction.

Wax, for example, thermo-wax, is filled in the temperature responsive portion 52. The temperature responsive portion 52 is provided at a left-hand end of the shaft portion 511, that is, on an opposite side to the valve seat portion 541 of the supporting member 54. Therefore, the temperature responsive portion 52 is located in the fail-safe valve accommodation space 220. The temperature responsive portion 52 is connected to the left-hand end of the shaft portion 511, which is the opposite side to the valve head portion 512.

The spring 53 is composed of a coil spring and arranged in the supporting member 54. The spring 53 biases the shaft portion 511 in the fail-safe valve closing direction. The valve head portion 512 is thereby pushed to the valve seat portion 541 to close the same.

The temperature responsive portion 52 is expanded when the temperature of the cooling water in the fail-safe valve accommodation space 220 becomes higher than a predetermined value. Then, the temperature responsive portion 52 pushes the shaft portion 511 against the biasing force of the spring 53 in the fail-safe valve opening direction. As a result, the valve head portion 512 is separated from the valve seat portion 541 so as to open the same.

The fail-safe valve unit 50 is closed so as to block off the flow of the cooling water through the fail-safe water passage 253, when the temperature of the cooling water in the fail-safe valve accommodation space 220 is lower than the predetermined value. On the other hand, the fail-safe valve unit 50 is opened so as to allow the flow of the cooling water through the fail-safe water passage 253, when the temperature of the cooling water in the fail-safe valve accommodation space 220 is higher than the predetermined value.

As above, the fail-safe valve unit 50 independently operates from the main valve unit 30. The fail-safe valve unit 50 includes the valve portion 51 for opening or closing the fail-safe water passage 253 and the temperature responsive portion 52 for responding to the temperature of the cooling water in order to move the valve portion 51.

For example, even in a case that the main valve unit 30 becomes unable to rotate in the main valve accommodation space 210 and the flow of the cooling water to the radiator 11 via the main water passage 250 is blocked off, the fail-safe valve unit 50 is opened when the temperature of the cooling water is increased and becomes higher than the predetermined value. As a result, it is possible to allow the cooling water from the engine 2, the temperature of which is increased by the engine 2, to flow to the radiator 11 through the fail-safe valve accommodation space 220 and the fail-safe water passage 253. Therefore, it is possible to prevent temperature increase of the engine 2, even in the case that the main valve unit 30 becomes unable to rotate.

In the present embodiment, the above predetermined value, that is, the temperature at which the fail-safe valve unit 50 is opened, is selected in advance at an appropriate value in view of preventing an over heat of the engine 2.

In the present embodiment, the housing 20 further includes an inside communication hole 201. The inside communication hole 201 is formed in the housing body 21 so as to communicate the fail-safe valve accommodation space 220 to the inside space of the first passage hole portion 215, as shown in FIGS. 4, 5, 6 and 8.

When a part of the first valve communication hole 36 and a part of the opening portion of the first seat portion 61 (that is, a part of the main water passage 250) overlap with each other in the radial direction, the fail-safe valve accommodation space 220 is communicated to the opening portion of the first seat portion (that is, the main water passage 250) through the inside communication hole 201, a space between an inner peripheral surface of the first passage hole portion 215 and the outer peripheral surface of the holder 63 (as shown in FIG. 8), a part of the main valve accommodation space 210 (more exactly, a space outside of the main valve unit 30) and the first valve communication hole 36. In other words, when the part of the first valve communication hole 36 overlaps with the main water passage 250, the inside communication hole 201 communicates the fail-safe valve accommodation space 220 to the main water passage 250 via the first valve communication hole 36.

As above, the inside communication hole 201 communicates the fail-safe valve accommodation space 220 to the main water passage 250, when a predetermined condition is satisfied, that is, when the part of the first valve communication hole 36 overlaps with the opening portion of the first seat portion 61 (the main water passage 250).

When air bubbles flow into or the air bubbles are generated in the fail-safe valve accommodation space 220, the air bubbles may be adhered to the temperature responsive portion 52. In such a case, heat-transfer performance from the cooling water to the temperature responsive portion 52 is decreased. Then, it may become difficult for the temperature responsive portion 52 to exactly detect the temperature of the cooling water, when the temperature of the cooling water becomes higher than the predetermined value. It may cause a defect that the fail-safe valve unit 50 does not properly operate.

According to the present embodiment, however, it is possible to discharge the air bubbles to the main water passage 250, when the fail-safe valve accommodation space 220 is communicated to the main water passage 250 through the inside communication hole 201. Therefore, it is possible to prevent the air bubbles from being adhered to the temperature responsive portion 52 of the fail-safe valve unit 50. Accordingly, it is possible to exactly detect the temperature increase of the cooling water by the temperature responsive portion 52 and thereby to prevent an operational failure of the fail-safe valve unit 50.

As shown in FIGS. 5 and 8, the inside communication hole 201 is formed in the housing body 21 at a position, which is outside of the inner peripheral surface of the first holder 63, that is, outside of the inner peripheral surface of the main water passage 250 (FIG. 8), and which is further radial-outside of the main valve unit 30 with respect to a sealing surface S1 between the outer wall surface of the main valve unit 30 and the main water passage 250 (FIG. 5). In other words, the inside communication hole 201 is located not only at the radial-outside position of the main water passage 250 but also at the radial-outside position of the main valve accommodation space 210. As a result, it is possible to block off the communication between the fail-safe valve accommodation space 220 and the main water passage 250 via the inside communication hole 201, when the overlapping area between the first valve communication hole 36 and the main water passage 250 is zero, namely when the opening portion of the first seat portion 61 is entirely closed by the first ball surface portion 34. Therefore, the cooling water does not flow from the fail-safe valve accommodation space 220 to the main water passage 250 via the inside communication hole 201. In other words, the cooling water does not flow from the fail-safe valve accommodation space 220 to the radiator 11, when the flow of the cooling water is blocked off from the main valve accommodation space 210 to the main water passage 250.

As shown in FIGS. 4 to 8, the water valve device 10 of the present embodiment is fixed to the engine 2 in such a way that the water valve device 10 is attached to an upper side of the engine 2 in a vertical direction. In a condition that the water valve device 10 is fixed to the engine 2, each of the first opening portion 211 and the second opening portion 221 is located at the upper side of the engine 2 in the vertical direction. Each of the main valve accommodation space 210 and the fail-safe valve accommodation space 220 is located at a position of a vertical upper side of the respective first and the second opening portions 211 and 221. In addition, the axis Ax1 of the main valve unit 30 coincides with the vertical direction.

As shown in FIG. 8, in an operating condition of the water valve device 10, that is, in the condition that the water valve device 10 is fixed to the engine 2, a vertical upper-side end "E1" of the inside communication hole 201 is located at a position, which is higher in the vertical direction than a vertical lower-side end "E2" of the fail-safe valve unit 50. It is possible to discharge the air bubbles from the fail-safe valve accommodation space 220 to the main water passage 250 via the inside communication hole 201. As a result, a major portion of the fail-safe valve unit 50 is in contact with the cooling water.

In addition, in the condition that the water valve device 10 is fixed to the engine 2, each of the inside communication hole 201 and the fail-safe valve unit 50 is located at a position higher in the vertical direction than the second opening portion 221. Therefore, a relationship of "L1≥L2" is satisfied, wherein a first distance "L1" is a vertical distance from the second opening portion 221 to the vertical upper-side end "E1" of the inside communication hole 201 and a second distance "L2" is a vertical distance from the second opening portion 221 to a vertical upper-side end "E3" of the temperature responsive portion 52. Accordingly, it is possible to surely discharge the air bubbles from the fail-safe valve accommodation space 220 to the outside thereof. As above, the major portion of the fail-safe valve unit 50 is in contact with the cooling water.

In the present embodiment, the water valve device 10 has the following advantages.

(1A) The water valve device 10, which controls the flow rate of the cooling water to be recirculated from and to the engine 2, has the housing 20, the main valve unit 30 and the fail-safe valve unit 50.

The housing 20 includes the main valve accommodation space 210, the first opening portion 211 for connecting the main valve accommodation space 210 to the engine 2, the fail-safe valve accommodation space 220, the second opening portion 221 for connecting the fail-safe valve accommodation space 220 to the engine 2, the main water passage 250 for connecting the main valve accommodation space 210 to the outside of the water valve device 10 (for example, the radiator 11), the fail-safe water passage 253 for connecting the fail-safe valve accommodation space 220 to the main water passage 250 and so on.

The main valve unit 30 is rotatably provided in the main valve accommodation space 210 and controls the flow rate of the cooling water, which flows from the first opening portion 211 to the main water passage 250, depending on the rotational position of the valve body 31 of the main valve unit 30.

The fail-safe valve unit 50 is provided in the fail-safe valve accommodation space 220. The fail-safe valve unit 50 closes the fail-safe water passage 253 when the temperature of the cooling water is lower than the predetermined value, to thereby block off the flow of the cooling water through the fail-safe water passage 253. The fail-safe valve unit 50 opens the fail-safe water passage 253 when the temperature of the cooling water is higher than the predetermined value, to thereby allow the flow of the cooling water through the fail-safe water passage 253. According to the above structure, it is possible to supply the cooling water to the radiator 11 located at the outside of the water valve device 10 via the fail-safe valve accommodation space 220 and the fail-safe water passage 253, even in the case that the main valve unit 30 becomes unable to rotate in the main valve accommodation space 210. In the above case, the flow of the cooling water from the main water passage 250 to the outside of the water valve device 10 is blocked off and the temperature of the cooling water becomes higher than the predetermined value. In the present embodiment, since the cooling water, the temperature of which is increased by the engine 2, can be supplied to the radiator 11 via the fail-safe valve unit 50 even when the main valve unit 30 has the operational failure, it is possible to prevent the temperature increase of the engine 2.

The partitioning wall 222 is formed in the housing 20 so as to partition each of the first opening portion 211 and the main valve accommodation space 210 from the second opening portion 221 and the fail-safe valve accommodation space 220. In other words, each of the first opening portion 211 and the main valve accommodation space 210 is fluidically insulated from the second opening portion 221 and the fail-safe valve accommodation space 220. As a result, any broken piece of the main valve unit 30 cannot enter the fail-safe valve accommodation space 220, even when the extraneous material stops the rotation of the main valve unit 30 and the main valve unit 30 is broken in the main valve accommodation space 210. Accordingly, it is possible to prevent the broken piece of the main valve unit 30 from being attached to the valve head portion 512 of the fail-safe valve unit 50. In other words, it is possible to prevent the functional failure of the fail-safe valve unit 50.

(1B) In addition, the housing 20 has the inside communication hole 201 for communicating the fail-safe valve accommodation space 220 to the main water passage 250. According to the above structure, even in the case that the air bubbles flow into or the air bubbles are generated in the fail-safe valve accommodation space 220, it is possible to discharge the air bubbles from the fail-safe valve accommodation space 220 to the main water passage 250, when the fail-safe valve accommodation space 220 is communicated to the main water passage 250 through the inside communication hole 201. Accordingly, it is possible to prevent the air bubbles from being adhered to the fail-safe valve unit 50. In other words, it is possible to exactly detect the temperature of the cooling water by the fail-safe valve unit 50 (having the temperature responsive portion 52) and to prevent the fail-safe valve unit 50 from its operational failure.

(1C) Furthermore, the main valve unit 30 is formed in the cylindrical shape and has the first valve communication hole 36 at the valve cylindrical portion 32 for connecting the inside space to the outside space of the valve body 31. The axial open end (the lower-side end) of the housing body 21 is communicated to the first opening portion 211. The main valve unit 30 is rotatably supported in the housing 20 so that the main valve unit 30 rotates about the axis Ax1. When the main valve unit 30 is rotated, the overlapping area between the first valve communication hole 36 and the main water passage 250 is changed so as to control the flow rate of the cooling water flowing from the first opening portion 211 to the main water passage 250.

The inside communication hole 201 is formed in the housing 20 at the position, which is the radial-outside position of the inner peripheral wall of the main water passage 250. The inside communication hole 201 is further located at the position, which is separated from the sealing surface S1 formed between the outer wall surface of the valve body 31 and the main water passage 250, in the radial direction of the valve body 31 from the axis "Ax1" to the first pipe unit 25. According to the above structure, the communication between the fail-safe valve accommodation space 220 and the main water passage 250 via the inside communication hole 201 is blocked off, when the overlapping area between the first valve communication hole 36 and the main water passage 250 becomes zero, namely when the opening portion of the first seat portion 61 is entirely closed by the first ball surface portion 34. Therefore, in such a closed condition of the first valve communication hole 36, the cooling water does not flow from the fail-safe valve accommodation space 220 to the main water passage 250 (namely to the radiator 11) via the inside communication hole 201. It is, therefore, possible to quickly warm up the engine 2 when the ambient temperature is low.

(1D) In the present embodiment, the inside communication hole 201 communicates the fail-safe valve accommodation space 220 to the main water passage 250 via the first valve communication hole 36, when the part of the first valve communication hole 36 overlaps with the main water passage 250. The communication between the fail-safe valve accommodation space 220 and the main water passage 250 is blocked off, when the overlapping area between the first valve communication hole 36 and the main water passage 250 becomes zero. On the other hand, the fail-safe valve accommodation space 220 is communicated to the main water passage 250, when the part of the first valve communication hole 36 overlaps with the main water passage 250. When the communication between the fail-safe valve accommodation space 220 and the main water passage 250 is blocked off, it is possible to quickly warm up the engine 2. On the other hand, when the fail-safe valve accommodation space 220 is communicated to the main water passage 250, it is possible to discharge the air bubbles from the fail-safe valve accommodation space 220.

(1E) In the condition that the water valve device 10 is operated, the vertical upper-side end "E1" of the inside communication hole 201 is located at the position, which is higher in the vertical direction than the vertical lower-side end "E2" of the fail-safe valve unit 50. According to the above structure, it is possible not only to discharge the air bubbles from the fail-safe valve accommodation space 220 to the main water passage 250 via the inside communication hole 201, but also to bring the major portion of the fail-safe valve unit 50 into contact with the cooling water.

(1F) The fail-safe valve unit 50 includes the temperature responsive portion 52 for responding to the temperature of the cooling water so as to open or close the fail-safe valve unit 50 depending on the temperature detected by the temperature responsive portion 52.

In addition, in the condition that the water valve device 10 is fixed to the engine 2, each of the inside communication hole 201 and the fail-safe valve unit 50 is located at the position higher in the vertical direction than the second opening portion 221. Furthermore, the relationship of "L1≥L2" is satisfied, wherein the first distance "L1" is the vertical distance from the second opening portion 221 to the vertical upper-side end "E1" of the inside communication hole 201 and the second distance "L2" is the vertical distance from the second opening portion 221 to the vertical upper-side end "E3" of the temperature responsive portion 52. It is, therefore, possible to surely discharge the air bubbles from the fail-safe valve accommodation space 220 to the outside thereof. And the major portion of the fail-safe valve unit 50 is in contact with the cooling water. Accordingly, it is possible to more exactly detect the temperature of the cooling water by the temperature responsive portion 52 and thereby to prevent the operational failure of the fail-safe valve unit 50.

(Second Embodiment)

Figure 9:
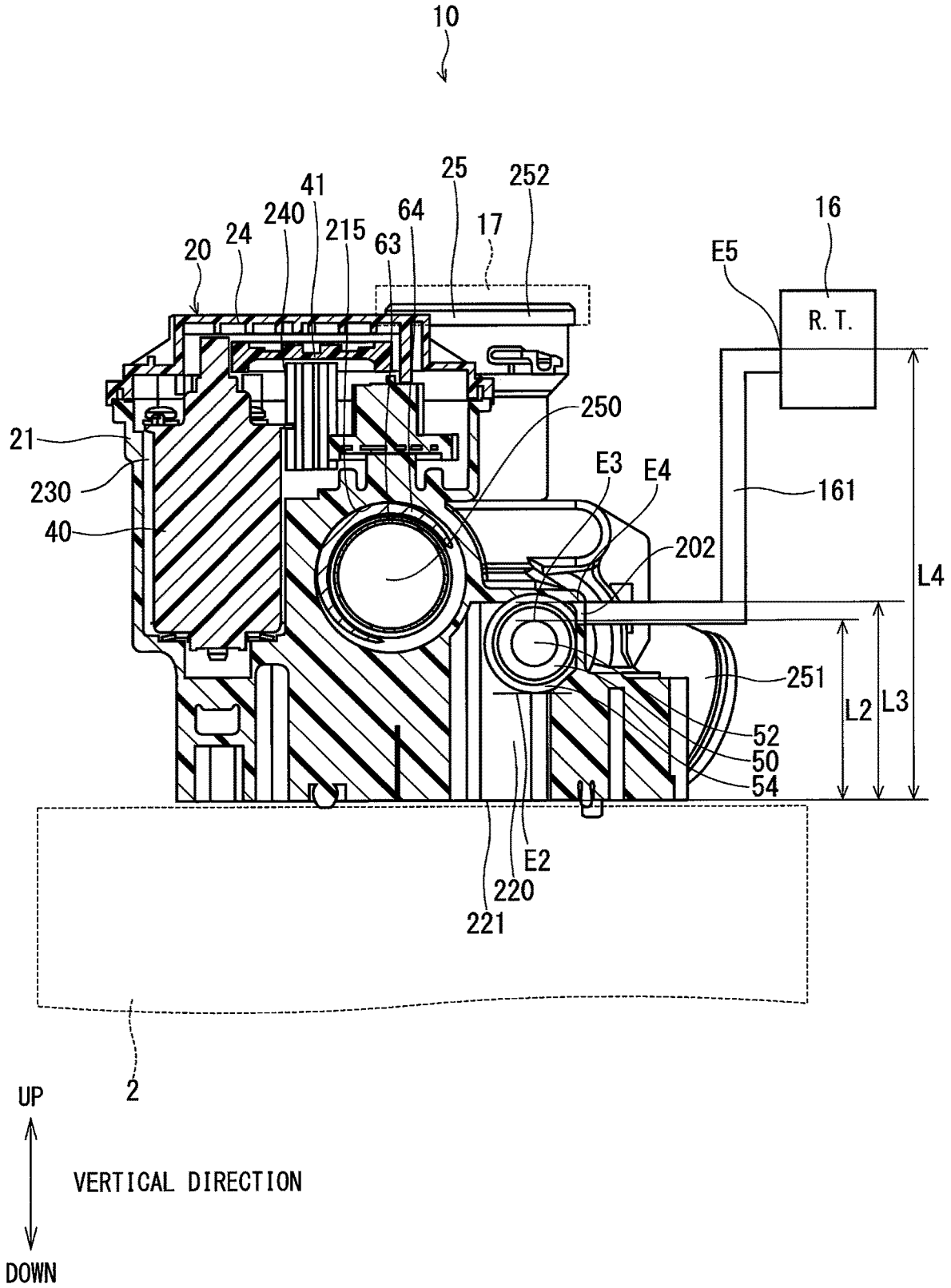
FIG. 9 is a schematic cross sectional view showing the cooling-water control valve device according to a second embodiment.

The water valve device 10 of a second embodiment is shown in FIG. 9.

In the second embodiment, the housing 20 does not have a structure corresponding to the inside communication hole 201 of the first embodiment. Instead, an outside communication hole 202 is formed in the housing body 21 for communicating the fail-safe valve accommodation space 220 to the outside of the housing 20 (one of the outside components), as shown in FIG. 9.

In the second embodiment, a pipe member 161 of a tube shape is provided. One end (a left-hand end in FIG. 9) of the pipe member 161 is connected to the outside communication hole 202, while the other end (a right-hand end in FIG. 9) of the pipe member 161 is connected to the reserve tank 16. As above, the other end of the pipe member 161 is connected to one of the outside components (the reserve tank 16) located at the outside of the housing 20. The outside communication hole 202 is connected to the left-hand end of the pipe member 161, which is a lower-side end of the pipe member 161 opposite to an upper-side end (the right-hand end).

Since the fail-safe valve accommodation space 220 is communicated to the reserve tank 16 via the outside communication hole 202 and the pipe member 161, it is possible to discharge the air bubbles from the fail-safe valve accommodation space 220 to the reserve tank 16 via the outside communication hole 202 and the pipe member 161. Therefore, it is possible to prevent the air bubbles from being adhered to the temperature responsive portion 52 of the fail-safe valve unit 50.

As shown in FIG. 9, in the actual use condition of the water valve device 10, that is, in the condition that the water valve device 10 is fixed to the engine 2, a vertical upper-side end "E4" of the outside communication hole 202 is located at a position higher in the vertical direction than the vertical lower-side end "E2" of the fail-safe valve unit 50. As a result, it is possible not only to discharge the air bubbles from the fail-safe valve accommodation space 220 to the reserve tank 16 via the outside communication hole 202, but also to bring the major portion of the fail-safe valve unit 50 into contact with the cooling water.

In the actual use condition of the water valve device 10, the outside communication hole 202 as well as the fail-safe valve unit 50 is located at the position higher in the vertical direction than the second opening portion 221. A relationship of "L3≥L2" is satisfied, wherein "L2" is the second distance in the vertical direction from the second opening portion 221 to the vertical upper-side end "E3" of the temperature responsive portion 52, while "L3" is a third distance in the vertical direction from the second opening portion 221 to the vertical upper-side end "E4" of the outside communication hole 202. Accordingly, it is possible to surely discharge the air bubbles from the fail-safe valve accommodation space 220 to the outside of the housing 20 via the outside communication hole 202. In addition, the entire portion of the fail-safe valve unit 50 can be brought in contact with the cooling water.

In addition, a relationship of "L4≥L3" is satisfied in the present embodiment in the actual use condition. In the above relationship, "L3" is the third distance in the vertical direction from the second opening portion 221 to the vertical upper-side end "E4" of the outside communication hole 202, while "L4" is a fourth distance from the second opening portion 221 to a vertical upper-side end "E5" of a connecting portion between the pipe member 161 and the reserve tank 16. Therefore, it is possible to surely discharge the air bubbles from the fail-safe valve accommodation space 220 to the outside component (the reserve tank 16) via the outside communication hole 202. In addition, the entire portion of the fail-safe valve unit 50 can be brought in contact with the cooling water.

The water valve device 10 of the second embodiment has the following advantages:

(2A) In the present embodiment, the housing 20 has the fail-safe valve accommodation space 220 and the outside communication hole 202 to be connected to the outside of the housing 20 (for example, the reserve tank 16). It is, therefore, possible to discharge the air bubbles from the fail-safe valve accommodation space 220 to the outside of the housing 20 via the outside communication hole 202, even when the air bubbles enter or the air bubbles are generated in the fail-safe valve accommodation space 220. In addition, it is possible to prevent the air bubbles from being adhered to the temperature responsive portion 52 of the fail-safe valve unit 50. Accordingly, it is possible to exactly detect by the temperature responsive portion 52 the temperature of the cooling water and to prevent the operational failure of the fail-safe valve unit 50.

(2B) In the actual use condition of the water valve device 10 of the present embodiment, the vertical upper-side end "E4" of the outside communication hole 202 is located at the position higher in the vertical direction than the vertical lower-side end "E2" of the fail-safe valve unit 50. As a result, it is possible not only to discharge the air bubbles from the fail-safe valve accommodation space 220 to the reserve tank 16 via the outside communication hole 202, but also to bring the major portion of the fail-safe valve unit 50 into contact with the cooling water. It is, therefore, possible to exactly detect the temperature of the cooling water and to prevent the operational failure of the fail-safe valve unit 50.

(2C) In the actual use condition of the water valve device 10, the outside communication hole 202 as well as the fail-safe valve unit 50 is located at the position higher in the vertical direction than the second opening portion 221. The relationship of "L3≥L2" is satisfied, wherein "L2" is the second distance in the vertical direction from the second opening portion 221 to the vertical upper-side end "E3" of the temperature responsive portion 52, while "L3" is the third distance in the vertical direction from the second opening portion 221 to the vertical upper-side end "E4" of the outside communication hole 202. Accordingly, it is possible to surely discharge the air bubbles from the fail-safe valve accommodation space 220 to the outside of the housing 20 via the outside communication hole 202. In addition, since the entire portion of the fail-safe valve unit 50 can be brought in contact with the cooling water, the temperature responsive portion 52 can exactly detect the temperature of the cooling water and the operational failure of the fail-safe valve unit 50 can be prevented.

(2D) In the present embodiment, the outside communication hole 202 is connected to the outside component (the reserve tank 16) located at the outside of the housing 20. It is thereby possible to discharge the air bubbles from the fail-safe valve accommodation space 220 to the outside component via the outside communication hole 202 and the pipe member 161.

(2E) In the present embodiment, the outside component is the reserve tank 16, which accumulates the cooling water for supplying the cooling water to the engine cooling system 1 when the amount of the cooling water in the system becomes insufficient. Therefore, the air bubbles contained in the cooling water and discharged into the reserve tank 16 can be dispersed from the reserve tank 16 and/or a water pipe between the reserve tank 16 and the engine 2.

(2F) In addition, the relationship of "L4≥L3" is satisfied in the present embodiment in the actual use condition. "L3" is the third distance in the vertical direction from the second opening portion 221 to the vertical upper-side end "E4" of the outside communication hole 202, while "L4" is the fourth distance from the second opening portion 221 to the vertical upper-side end "E5" of the connecting portion between the pipe member 161 and the reserve tank 16. Therefore, it is possible to surely discharge the air bubbles from the fail-safe valve accommodation space 220 to the reserve tank 16. In addition, the entire portion of the fail-safe valve unit 50 can be brought in contact with the cooling water. The temperature responsive portion 52 can exactly detect the temperature of the cooling water and the operational failure of the fail-safe valve unit 50 can be prevented.

(Third Embodiment)

Figure 10:
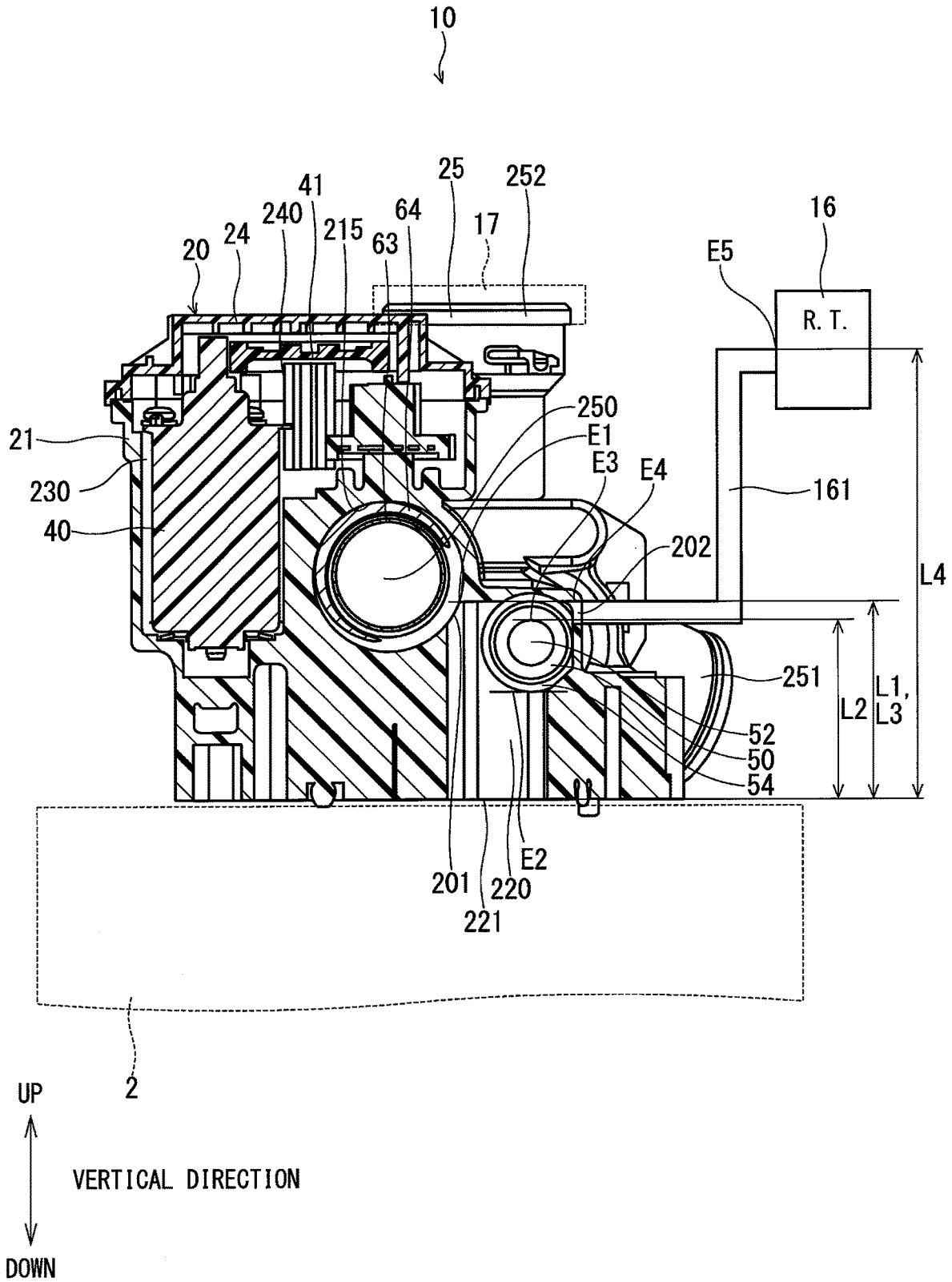
FIG. 10 is a schematic cross sectional view showing the cooling-water control valve device according to a third embodiment.

The water valve device 10 of a third embodiment is shown in FIG. 10.

The third embodiment is a combination of the first and the second embodiments. Namely, the water valve device 10 of the third embodiment has both of the inside communication hole 201 and the outside communication hole 202.

In the third embodiment, the positional relationships of the inside communication hole 201 and the outside communication hole 202 relative to each of the second opening portion 221, the fail-safe valve unit 50, the pipe member 161 and the reserve tank 16 are the same to those of the first and the second embodiments. Therefore, the same advantages to those of the first and the second embodiments can be obtained in the third embodiment.

(Fourth Embodiment)

Figure 11:
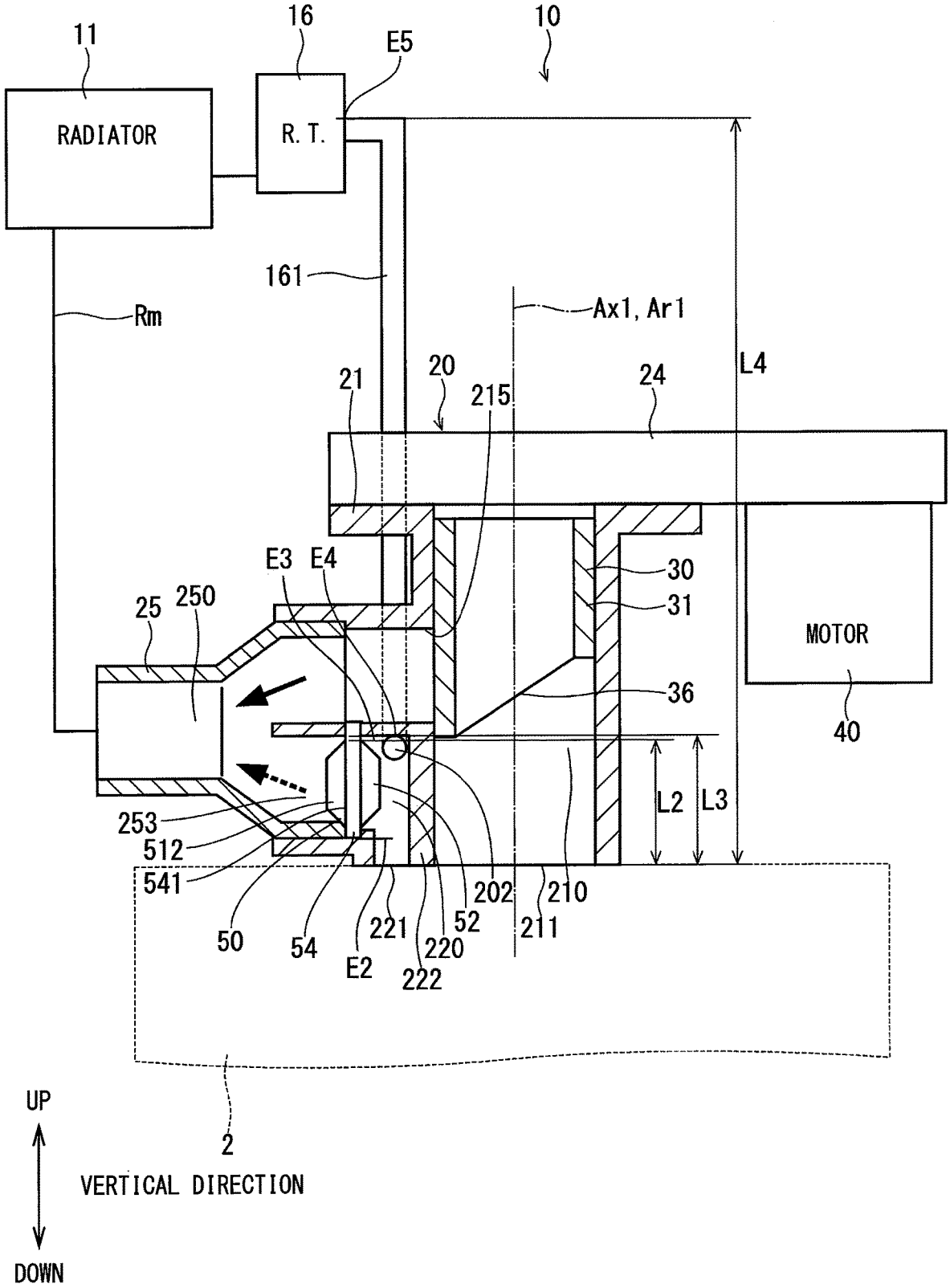
FIG. 11 is a schematic cross sectional view showing the cooling-water control valve device according to a fourth embodiment.

The water valve device 10 of a fourth embodiment is shown in FIG. 11. The main valve unit 30, the housing 20 and the fail-safe valve unit 50 of the fourth embodiment are different from those of the second embodiment.

In a similar manner to the second embodiment, the housing 20 of the fourth embodiment has the partitioning wall 222 for fluidically partitioning the first opening portion 211 and the main valve accommodation space 210 from the second opening portion 221 and the fail-safe valve accommodation space 220.

In the present embodiment, the main valve accommodation space 210 is formed in a cylindrical shape.

The valve body 31 of the main valve unit 30 is also formed in the cylindrical shape, so that the valve body 31 has the cylindrical outer wall surface. The main valve unit 30 is rotatably accommodated in the main valve accommodation space 210, so that the valve body 31 is rotatable with respect to the axis Ax1. The cylindrical outer wall surface of the valve body 31 is slidable with respect to an inner wall surface of the housing body 21, that is, the inner peripheral surface of the main valve accommodation space 210.

The valve communication hole 36 is formed in the valve body 31 by cutting away a part of a lower-side end of the valve body 31, that is, an end closer to the first opening portion 211. As a result, the valve communication hole 36 operatively communicates the inside space of the valve body 31 to the outside space thereof.

In the present embodiment, the main water passage 250 is formed by a part of the first passage hole portion 215 and a part of the first pipe unit 25.

The main valve unit 30 is rotated by the torque outputted from the electric motor 40. When the overlapping area between the valve communication hole 36 and the main water passage 250 is zero, that is, when the main water passage 250 is closed by the outer wall surface of the valve body 31, the communication between the first opening portion 211 and the main water passage 250 is blocked off. When a part of the valve communication hole 36 overlaps with the main water passage 250, the main valve unit 30 allows the flow of the cooling water from the first opening portion 211 to the main water passage 250. The cooling water flows from the main water passage 250 to the radiator 11 via the main water pipe Rm, wherein the flow rate of the cooling water depends on the overlapping area between the valve communication hole 36 and the main water passage 250.

The fail-safe valve unit 50 includes the temperature responsive portion 52, the valve portion 512 and the supporting member 54. The supporting member 54 is provided in the housing body 21 between the fail-safe valve accommodation space 220 and the fail-safe water passage 253. The supporting member 54 supports the temperature responsive portion 52 and the valve portion 512.

The temperature responsive portion 52 is expanded when the temperature of the cooling water in the fail-safe valve accommodation space 220 becomes higher than the predetermined value so as to push the valve portion 512 in the fail-safe valve opening direction. The valve portion 512 is thereby separated from the valve seat portion 541 so as to open the passage between the fail-safe valve accommodation space 220 and the fail-safe water passage 253.

The fail-safe valve unit 50 is closed when the temperature of the cooling water in the fail-safe valve accommodation space 220 is lower than the predetermined value, so as to block off the flow of the cooling water to the fail-safe water passage 253. When the temperature of the cooling water is higher than the predetermined value, the fail-safe valve unit 50 is opened to allow the flow of the cooling water to the fail-safe water passage 253.

In the present embodiment, the housing 20 has the outside communication hole 202, which is formed in the housing body 21 for communicating the fail-safe valve accommodation space 220 to the outside of the housing 20. The outside communication hole 202 is connected to one end of the pipe member 161, the other end of which is connected to the reserve tank 16 located at the outside of the water valve device 10. As above, the fail-safe valve accommodation space 220 is communicated to the reserve tank 16 via the outside communication hole 202 and the pipe member 161.

As shown in FIG. 11, the water valve device 10 is fixed to the vertical upper side of the engine 2. In the actual use condition of the water valve device 10 fixed to the engine 2, each of the first opening portion 211 and the second opening portion 221 is located at the vertical upper side of the engine 2. Each of the main valve accommodation space 210 and the fail-safe valve accommodation space 220 is located at the position on the vertical upper side of the first and the second opening portions 211 and 221. In the above condition, the main valve unit 30 is positioned in such a way that the axis Ax1 of the valve body 31 extends in the vertical direction.

As shown in FIG. 11, in the actual use condition of the water valve device 10 fixed to the engine 2, the vertical upper-side end "E4" of the outside communication hole 202 is located at the position higher in the vertical direction than the vertical lower-side end "E2" of the fail-safe valve unit 50. According to the above structure, it is possible to discharge the air bubbles from the fail-safe valve accommodation space 220 to the outside of the housing 20 via the outside communication hole 202. In addition, the major portion of the fail-safe valve unit 50 is in contact with the cooling water. Therefore, the temperature responsive portion 52 can exactly detect the temperature of the cooling water and prevent the operational failure of the fail-safe valve unit 50.

In addition, in the actual use condition of the water valve device 10, each of the outside communication hole 202 and the fail-safe valve unit 50 is located at the position higher in the vertical direction than the second opening portion 221. The relationship of "L3≥L2" is satisfied, wherein "L2" is the second distance from the second opening portion 221 to the vertical upper-side end "E3" of the temperature responsive portion 52, while "L3" is the third distance from the second opening portion 221 to the vertical upper-side end "E4" of the outside communication hole 202. As a result, it is possible to surely discharge the air bubbles from the fail-safe valve accommodation space 220 to the outside of the housing 20 via the outside communication hole 202. In addition, the entire portion of the fail-safe valve unit 50 is in contact with the cooling water. Therefore, the temperature responsive portion 52 can exactly detect the temperature of the cooling water and prevent the operational failure of the fail-safe valve unit 50.

Furthermore, in the actual use condition of the water valve device 10, the relationship of "L4≥L3" is satisfied. "L3" is the third distance from the second opening portion 221 to the vertical upper-side end "E4" of the outside communication hole 202. "L4" is the fourth distance from the second opening portion 221 to the vertical upper-side end "E5" of the connecting portion between the pipe member 161 and the reserve tank 16. As a result, it is possible to surely discharge the air bubbles from the fail-safe valve accommodation space 220 to the reserve tank 16 via the outside communication hole 202. In addition, the entire portion of the fail-safe valve unit 50 is in contact with the cooling water. Therefore, the temperature responsive portion 52 can exactly detect the temperature of the cooling water and prevent the operational failure of the fail-safe valve unit 50.

As above, the advantages of the second embodiment can be also obtained in the fourth embodiment.

(Fifth Embodiment)

Figure 12:
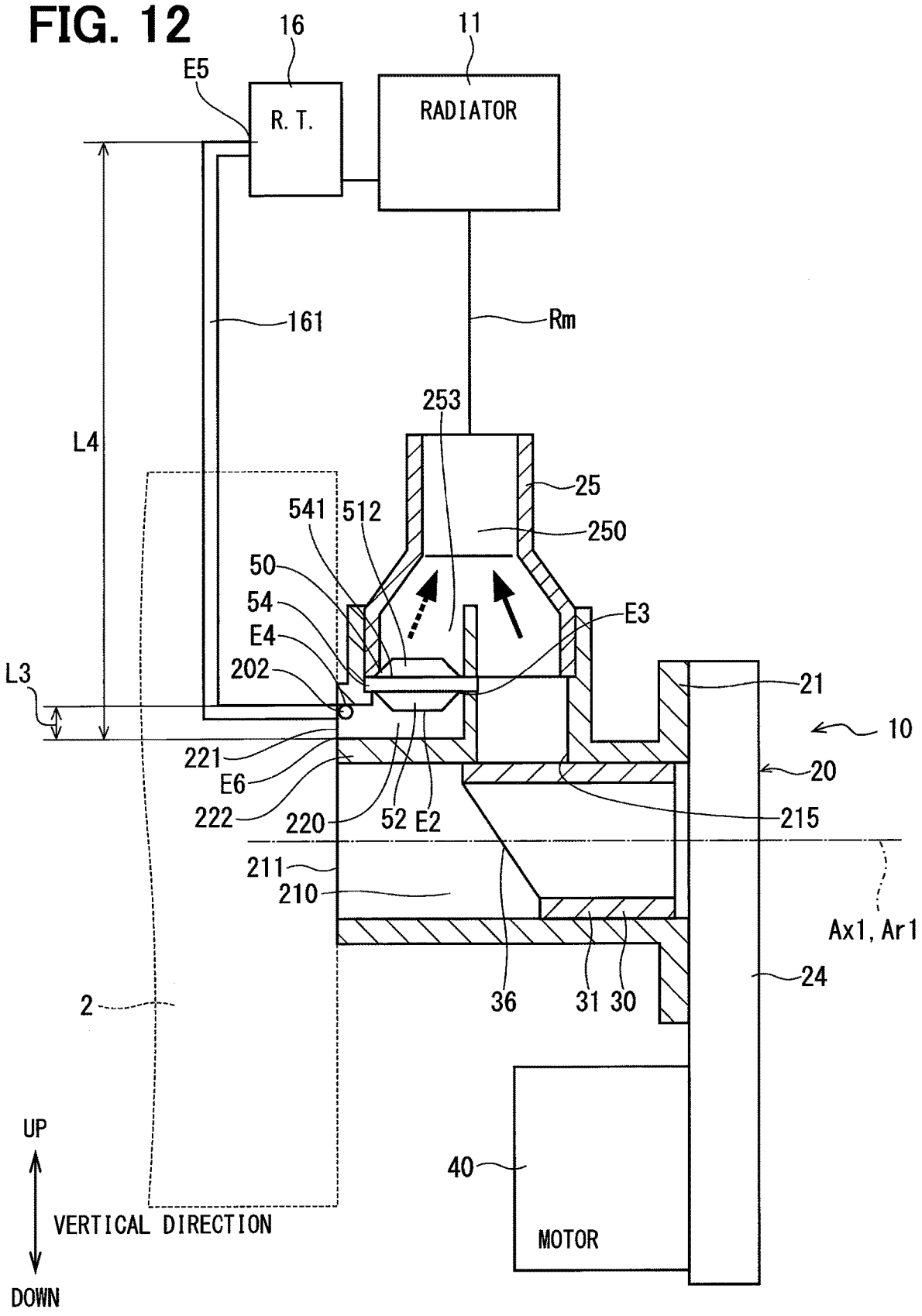
FIG. 12 is a schematic cross sectional view showing the cooling-water control valve device according to a fifth embodiment.

The water valve device 10 of a fifth embodiment will be explained with reference to FIG. 12. The fifth embodiment is different from the fourth embodiment in a position for fixing the water valve device 10 to the engine 2.

In the fifth embodiment, the water valve device 10 is fixed to a side wall of the engine 2. In the condition that the water valve device 10 is fixed to the engine 2, each of the first opening portion 211 and the second opening portion 221 is located at a horizontal side position of the engine 2. Each of the main valve accommodation space 210 and the fail-safe valve accommodation space 220 is located at each horizontal side position of the first and the second opening portions 211 and 221. The axis Ax1 of the valve body 31 of the main valve unit 30 extends in the horizontal direction. The fail-safe valve accommodation space 220 is located a position higher in the vertical direction than the main valve accommodation space 210.

The outside communication hole 202 is formed in the housing body 21 at a position neighboring to the second opening portion 221. As shown in FIG. 12, in the actual use condition of the water valve device 10 fixed to the engine 2, the vertical upper-side end "E4" of the outside communication hole 202 is located at the position higher in the vertical direction than the vertical lower-side end "E2" of the fail-safe valve unit 50. As a result, it is possible to discharge the air bubbles from the fail-safe valve accommodation space 220 to the outside of the water valve device 10 via the outside communication hole 202. In addition, the major portion of the fail-safe valve unit 50 is in contact with the cooling water. As above, the temperature responsive portion 52 can exactly detect the temperature of the cooling water and prevent the operational failure of the fail-safe valve unit 50.

In addition, in the actual use condition of the water valve device 10, the relationship of "L4≥L3" is satisfied. "L3" is the third distance from a vertical lower-side end "E6" of the second opening portion 221 to the vertical upper-side end "E4" of the outside communication hole 202. "L4" is the fourth distance from the vertical lower-side end "E6" of the second opening portion 221 to the vertical upper-side end "E5" of the connecting portion between the pipe member 161 and the reserve tank 16. Accordingly, it is possible to surely discharge the air bubbles from the fail-safe valve accommodation space 220 to the reserve tank 16 via the outside communication hole 202. In addition, the entire portion of the fail-safe valve unit 50 is in contact with the cooling water. As above, the temperature responsive portion 52 can exactly detect the temperature of the cooling water and prevent the operational failure of the fail-safe valve unit 50.

As above, the advantages of the fourth embodiment can be also obtained in the fifth embodiment.

(Further Embodiments and/or Modifications)

(M1) It is not always necessary to provide the inside communication hole 201 or the outside communication hole 202 in the housing 20.

(M2) The inside communication hole 201 may be formed at any other position than that of the above embodiments, so long as the inside communication hole 201 communicates the fail-safe valve accommodation space 220 to the main water passage 250.

(M3) In the actual use condition of the water valve device 10 in the first embodiment (FIG. 8), the vertical upper-side end "E1" of the inside communication hole 201 may be formed either at the same vertical position to that of the vertical lower-side end "E2" of the fail-safe valve unit 50.

(M4) The relationship of "L1≥L2", for example, in the first embodiment (FIG. 8) may be changed to a relationship of "L1<L2", wherein "L1" is the first distance from the second opening portion 221 to the vertical upper-side end "E1" of the inside communication hole 201, while "L2" is the second distance from the second opening portion 221 to the vertical upper-side end "E3" of the temperature responsive portion 52.

(M5) For example, in the second embodiment (FIG. 9), the vertical upper-side end "E4" of the outside communication hole 202 may be formed either at the same vertical position to that of the vertical lower-side end "E2" of the fail-safe valve unit 50 or at the position lower in the vertical direction than the vertical lower-side end "E2".

(M6) The relationship of "L3≥L2", for example, in the second embodiment (FIG. 9) may be changed to a relationship of "L3<L2", wherein "L2" is the second distance from the second opening portion 221 to the vertical upper-side end "E3" of the temperature responsive portion 52, while "L3" is the third distance from the second opening portion 221 to the vertical upper-side end "E4" of the outside communication hole 202.

(M7) In the second embodiment, the outside communication hole 202 is connected to one of the outside components (the reserve tank 16) via the pipe member 161. The outside component is not limited to the reserve tank 16 but the outside communication hole 202 may be connected to any of the other outside components of the water valve device 10, for example, the radiator 11.

(M8) The relationship of "L4≥L3", for example, in the second embodiment (FIG. 9) may be changed to a relationship of "L4<L3", wherein "L3" is the third distance from the second opening portion 221 to the vertical upper-side end "E4" of the outside communication hole 202, while "L4" is the fourth distance from the second opening portion 221 to the vertical upper-side end "E5" of the connecting portion between the pipe member 161 and the outside component (the reserve tank 16).

(M9) The water valve device 10 is applied to the engine cooling system 1 in the above embodiments. However, the water valve device 10 of the present disclosure may be applied to any other cooling systems, for example, a cooling system for cooling down an electric driving motor and/or a cooling system for cooling down a battery installed in a hybrid vehicle or an electric vehicle.

(M10) In addition, the housing 20 may be made of not resin but metal.

As above, the present disclosure is not limited to the above embodiments and/or modifications, but can be further modified in various manners without departing from a spirit of the present disclosure.

What is claimed is:

1. A cooling-water control valve device, which is provided in a cooling system for cooling down a cooling-subject device and controls a flow rate of cooling water to the cooling-subject device, comprising:

(1) a housing including;

(1a) a main valve accommodation space;

(1b) a first opening portion for communicating the main valve accommodation space to the cooling-subject device, so that cooling water flows from the cooling-subject device to the main valve accommodation space through the first opening portion;

(1c) a fail-safe valve accommodation space;

(1d) a second opening portion for communicating the fail-safe valve accommodation space to the cooling-subject device, so that the cooling water flows from the cooling-subject device to the fail-safe valve accommodation space not through the first opening portion but through the second opening portion;

(1e) a main water passage to be connected to a main outside component for communicating the main valve accommodation space to the main outside component; and (1f) a fail-safe water passage for communicating the fail-safe valve accommodation space to the main water passage;

(2) a main valve unit rotatably provided in the main valve accommodation space, so as to control the flow rate of the cooling water from the first opening portion to the main water passage depending on a rotational position of the main valve unit;

(3) a fail-safe valve unit provided in the fail-safe valve accommodation space and operated in such a manner that;

(3a) the fail-safe valve unit is closed when temperature of the cooling water is lower than a predetermined value so as to block off flow of the cooling water from the second opening portion to the fail-safe water passage; and (3b) the fail-safe valve unit is opened when the temperature of the cooling water is higher than the predetermined value so as to allow the flow of the cooling water from the second opening portion to the fail-safe water passage; and (4) a partitioning wall formed in the housing for fluidically partitioning each of the first opening portion and the main valve accommodation space respectively from the second opening portion and the fail-safe valve accommodation space, so that an upstream-side space of the fail-safe valve accommodation space and the main valve accommodation space are not directly communicated to each other.

2. The cooling-water control valve device according to claim 1, wherein the housing further includes an inside communication hole for communicating the fail-safe valve accommodation space to the main water passage.

3. The cooling-water control valve device according to claim 2, wherein a valve body of the main valve unit is formed in a cylindrical shape and has a valve communication hole formed in a cylindrical wall portion of the valve body for connecting an inside space to an outside space of the valve body, an axial open end of the valve body is connected to the first opening portion, so that the cooling water flows from the cooling-subject device into the inside space of the valve body, the valve body is rotatably provided in the main valve accommodation space so as to be rotated about an axis of the valve body, an overlapping area between the valve communication hole and the main water passage is changed depending on the rotational position of the main valve unit so as to control the flow rate of the cooling water flowing from the first opening portion to the main water passage, and the inside communication hole is formed at a radial-outside position of an inner peripheral wall of the main water passage and at a radial-outside position of a sealing surface, which is formed between the cylindrical wall portion of the valve body and the main water passage.

4. The cooling-water control valve device according to claim 3, wherein the inside communication hole communicates the fail-safe valve communication space to the main water passage via the valve communication hole, when a part of the valve communication hole overlaps with the main water passage.

5. The cooling-water control valve device according to claim 2, wherein in an actual use condition of the cooling-water control valve device, a vertical upper-side end of the inside communication hole is located at a position higher in a vertical direction than a vertical lower-side end of the fail-safe valve unit.

6. The cooling-water control valve device according to claim 2, wherein the fail-safe valve unit includes a temperature responsive portion for detecting temperature of the cooling water, the fail-safe valve unit is opened or closed depending on the temperature detected at the temperature responsive portion, and each of the inside communication hole and the fail-safe valve unit is located at a position higher in the vertical direction than the second opening portion and a relationship of "L1≥L2" is satisfied in an actual use condition of the cooling-water control valve device, wherein "L1" is a first distance in the vertical direction from the second opening portion to a vertical upper-side end of the inside communication hole and "L2" is a second distance in the vertical direction from the second opening portion to a vertical upper-side end of the temperature responsive portion.

7. The cooling-water control valve device according to claim 1, wherein the housing has an outside communication hole to be connected to any one of outside components, which include the main outside component and which are provided in the cooling system.

8. The cooling-water control valve device according to claim 7, wherein in an actual use condition of the cooling-water control valve device, a vertical upper-side end of the outside communication hole is located at a position higher in a vertical direction than a vertical lower-side end of the fail-safe valve unit.

9. The cooling-water control valve device according to claim 7, wherein the fail-safe valve unit includes a temperature responsive portion for detecting temperature of the cooling water, the fail-safe valve unit is opened or closed depending on the temperature detected at the temperature responsive portion, and each of the outside communication hole and the fail-safe valve unit is located at a position higher in the vertical direction than the second opening portion and a relationship of "L3 ≥L2" is satisfied in an actual use condition of the cooling-water control valve device, wherein "L2" is a second distance in a vertical direction from the second opening portion to a vertical upper-side end of the temperature responsive portion and "L3" is a third distance in the vertical direction from the second opening portion to a vertical upper-side end of the outside communication hole.

10. The cooling-water control valve device according to claim 7, wherein the outside communication hole is connected to one end of a pipe member, the other end of which is connected to one of the outside components.

11. The cooling-water control valve device according to claim 10, wherein the one of the outside components is a reserve tank for accumulating the cooling water in order that the cooling water is supplied from the reserve tank to the cooling-subject device when an amount of the cooling water becomes insufficient in the cooling-subject device.

12. The cooling-water control valve device according to claim 10, wherein each of the outside communication hole and the fail-safe valve unit is located at a position higher in the vertical direction than the second opening portion and a relationship of "L4 ≥L3" is satisfied in an actual use condition of the cooling-water control valve device, wherein "L3" is a third distance in the vertical direction from the second opening portion to a vertical upper-side end of the outside communication hole and "L4" is a fourth distance in the vertical direction from the second opening portion to a vertical upper-side end of a connecting portion between the pipe member and the outside component.

13. A cooling-water control valve device, which is provided in a cooling system for cooling down a cooling-subject device and controls a flow rate of cooling water to the cooling-subject device, comprising:

(1) a housing including;

(1a) a main valve accommodation space;

(1b) a first opening portion for communicating the main valve accommodation space to the cooling-subject device, so that cooling water flows from the cooling-subject device to the main valve accommodation space through the first opening portion;

(1c) a fail-safe valve accommodation space;

(1d) a second opening portion for communicating the fail-safe valve accommodation space to the cooling-subject device, so that the cooling water flows from the cooling-subject device to the fail-safe valve accommodation space;

(1e) a main water passage to be connected to a main outside component for communicating the main valve accommodation space to the main outside component; and (1f) a fail-safe water passage for communicating the fail-safe valve accommodation space to the main water passage;

(2) a main valve unit rotatably provided in the main valve accommodation space, so as to control the flow rate of the cooling water from the first opening portion to the main water passage depending on a rotational position of the main valve unit;

(3) a fail-safe valve unit provided in the fail-safe valve accommodation space and operated in such a manner that;

(3a) the fail-safe valve unit is closed when temperature of the cooling water is lower than a predetermined value so as to block off flow of the cooling water from the second opening portion to the fail-safe water passage; and (3b) the fail-safe valve unit is opened when the temperature of the cooling water is higher than the predetermined value so as to allow the flow of the cooling water from the second opening portion to the fail-safe water passage; and (4) a partitioning wall formed in the housing for fluidically partitioning each of the first opening portion and the main valve accommodation space respectively from the second opening portion and the fail-safe valve accommodation space; wherein the housing further includes an inside communication hole for communicating the fail-safe valve accommodation space to the main water passage;

a valve body of the main valve unit is formed in a cylindrical shape and has a valve communication hole formed in a cylindrical wall portion of the valve body for connecting an inside space to an outside space of the valve body, an axial open end of the valve body is connected to the first opening portion, so that the cooling water flows from the cooling-subject device into the inside space of the valve body, the valve body is rotatably provided in the main valve accommodation space so as to be rotated about an axis of the valve body, an overlapping area between the valve communication hole and the main water passage is changed depending on the rotational position of the main valve unit so as to control the flow rate of the cooling water flowing from the first opening portion to the main water passage, and the inside communication hole is formed at a radial-outside position of an inner peripheral wall of the main water passage and at a radial-outside position of a sealing surface, which is formed between the cylindrical wall portion of the valve body and the main water passage, and the inside communication hole communicates the fail-safe valve communication space to the main water passage via the valve communication hole, when a part of the valve communication hole overlaps with the main water passage.

* * * * *